US006244231B1

(12) United States Patent
Kouchi et al.

(10) Patent No.: US 6,244,231 B1
(45) Date of Patent: Jun. 12, 2001

(54) STRUCTURE OF OVERHEAD-VALVE INTERNAL COMBUSTION ENGINE AND MANUFACTURING METHOD FOR THE SAME

(75) Inventors: Hiroyoshi Kouchi; Kazuyuki Kobayashi; Shogo Nakamura; Isao Katayama; Shigeichi Okada, all of Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/666,532

(22) Filed: Sep. 20, 2000

Related U.S. Application Data

(62) Division of application No. 09/104,395, filed on Jun. 25, 1998.

(30) Foreign Application Priority Data

Jun. 25, 1997 (JP) ..... 9-184398
Feb. 24, 1998 (JP) ..... 10-058803

(51) Int. Cl.[7] ..... F01M 9/10

(52) U.S. Cl. ..... 123/90.33; 123/193.5; 123/196 M; 184/6.9

(58) Field of Search ..... 123/90.33, 90.38, 123/193.3, 193.5, 196 R, 196 M; 184/6.5, 6.9

(56) References Cited

U.S. PATENT DOCUMENTS

| | | | | |
|---|---|---|---|---|
| 4,563,986 | * | 1/1986 | Nakano | 123/90.38 |
| 4,688,529 | | 8/1987 | Mitadera et al. | 123/196 R |
| 4,858,575 | | 8/1989 | Fittro et al. | 123/90.41 |
| 4,969,434 | * | 11/1990 | Nakagawa | 123/196 M |
| 5,074,261 | * | 12/1991 | Hamburg et al. | 123/90.39 |
| 5,095,861 | * | 3/1992 | Dove, Jr. | 123/30.39 |
| 5,339,778 | * | 8/1994 | Reckzugel et al. | 123/193.5 |
| 5,617,818 | * | 4/1997 | Luders | 123/90.27 |
| 5,636,600 | * | 6/1997 | Sweetland et al. | 123/90.4 |
| 5,704,315 | * | 1/1998 | Tsuchida et al. | 123/90.16 |

FOREIGN PATENT DOCUMENTS

| | | |
|---|---|---|
| 2854405 | 6/1980 | (DE) . |
| 3636180 | 4/1988 | (DE) . |
| 0 279 445 | 8/1988 | (EP) . |
| 426064 | 3/1935 | (GB) . |
| 684221 | 12/1952 | (GB) . |
| 63-15530Y2 | 5/1988 | (JP) . |
| 2-7304 U | 1/1990 | (JP) . |
| 5-133204A | 5/1993 | (JP) . |
| 5-133205A | 5/1993 | (JP) . |
| 9-209826A | 8/1997 | (JP) . |

* cited by examiner

*Primary Examiner*—Wellun Lo
(74) *Attorney, Agent, or Firm*—Evenson, McKeown, Edwards & Lenahan, P.L.L.C.

(57) ABSTRACT

In order to supply a sufficient quantity of lubricating oil to the entire valve operating mechanism, we designed a lubrication device for an overhead valve engine. A first breather passage goes from the valve operating mechanism chamber to the crankcase, passing through the cylinder head and cylinder. The first breather passage opens in the vicinity of the spring retainer for the intake valve on the surface of the cylinder head which faces the valve operating mechanism chamber for the valve operating mechanism. The opening of the first passage and the vicinity of the exhaust valve are connected by a second breather passage. This second passage comprises a groove formed by cutting in the valve operating mechanism chamber surface of the cylinder head, and a tunnel formed between an oil guide wall which goes up from the valve operating mechanism chamber surface of the cylinder head and the peripheral wall of the head. One end of this groove connects to the opening of the first breather passage.

3 Claims, 17 Drawing Sheets

STRUCTURE OF OVERHEAD-VALVE INTERNAL COMBUSTION ENGINE AND MANUFACTURING METHOD FOR THE SAME

This application is a division of co-pending application Ser. No. 09/104,395, filed Jun. 25, 1998.

FIELD OF THE INVENTION

This invention concerns a structure of an overhead-valve internal combustion engine and the manufacturing method for it. More specifically, it concerns the configuration of the valve operating mechanism which operates the valves in an overhead-valve type internal combustion engine with an intake valve and an exhaust valve, and the lubrication device in the valve operating mechanism of the same kind of engine.

BACKGROUND OF THE INVENTION

It is relatively simple to assemble the valve-operating mechanism in an engine with the aforesaid bathtub-type combustion chamber. However, the combustion efficiency of this chamber is inferior to that of the aforesaid pent roof-type. In recent years, this has led to greater use of pent roof chambers.

FIGS. 18 and 19 show an example of an air-cooled single-cylinder overhead-valve four-cycle internal combustion engine with the aforesaid pent roof combustion chamber which belongs to the prior art. FIG. 18 is a cross section of the engine which includes the cylinder and the push rods. FIG. 19 is a cross section taken along line Z—Z in FIG. 18.

In FIGS. 18 and 19, 1 is the combustion chamber; 2 is the air-cooled cylinder; 5 is the crankshaft; 6 is the connecting rod; 7 is the piston; 8 is the cylinder head; 14*a* is the intake valve; and 14*b* is the exhaust valve (Hereafter, the aforesaid intake valve 14*a* and exhaust valve 14*b* will be referred to in common as induction/exhaust valves 14.)

17 is the camshaft, which is engaged with the aforesaid crankshaft 5 through a gear train; 17*a* is the cam on the said camshaft 17; 16 is the tappet; 15 is the push rod; 13 is the rocker arm shaft, which is fixed to and supported on rocker arm supporting base 22, which is itself fixed to the top of the aforesaid cylinder head 8. 11 is the rocker arm, which engages with the said rocker arm shaft 13 in such a way that it is free to swing. 18 is the valve spring. 19 is the valve spring bearing. 9 Is the head cover, which is mounted on top surface 8*b* on top of cylinder head 8 and which covers the mechanism which operates the valves. When this engine operates, induction/exhaust valves 14 open and close according to a timing determined by cam 17*a*, whose rotating speed is reduced to half that of crankshaft 5 by a timing gear (not pictured).

In FIG. 18, the rotation of camshaft 17*a* forces push rods 15 upward, and rocker arms 11 swing around shaft 13. Intake valve 14*a* or exhaust valve 14*b* is pushed upward against the elastic force of valve spring 18, and the valve opens.

In an OHV engine like this, to insure that the action of cam 17*a* is transmitted reliably to induction/exhaust valve 14 through push rods 15, the aforesaid valve spring 18 must have a relatively large spring constant, meaning that a strong spring must be used; and rocker arm shaft 13 must have a relatively large diameter.

To insure that the contacting surfaces of the valve operating mechanism do not experience excessive force when the engine is running and the cylinder head gets hot, an adjustment screw (not pictured) is provided to adjust the clearance between the contacting portions of rocker arms 11 and push rods 15.

In the aforesaid cylinder head 8, the aforesaid head cover 9 is hermetically sealed to top surface 8*b*, the upper surface of peripheral wall 8*c*, which surrounds the head. The aforesaid rocker arm supporting base 22 for the rocker arms is bolted to an area in the center of upper surface 8*a* which is lower than the said top surface 8*b* by a fixed amount.

In the four-cycle overhead valve internal combustion engine from the prior art which is pictured in FIGS. 18 and 19, there are two surfaces at the top of cylinder head 8, 8*b* and 8*a*. 8*b* is the top surface onto which head cover 9 is fixed; 8*a* is the mounting surface on which rocker arm supporting base 22, which supports the rocker arms, is fixed. These two surfaces must be finished by a machining process so that they are relatively smooth.

However, in the prior art cylinder head 8, top surface 8*b*, on which cover 9 is mounted, and mounting surface 8*a*, on which rocker arm supporting base 22 is mounted, are at different heights. This means that they must be machined in a two-stage process or that the machinist must change tools in mid-process. This increases the number of processes required and incurs an extra cost for set-up.

Designs for overhead valve engines with a hemispherical combustion chamber and the intake and exhaust valves arranged so that they radiate from the center have been proposed in Japanese Patent Publications (Kokai) Hei5-133205. In this prior art, one intake valve, one exhaust valve, and one spark plug are arranged so that the angles of these center lines (L1), (L2), (L3) against the center line of cylinder are same as each other, and they are located at a same distance from the center of the cylinder in order to manufacture the cylinder easily.

Another prior art is proposed in Japanese Patent Publications (Kokai) Hei5-133205. In both of these, however, the structure which supports the valve operating mechanism in the cylinder head is three-dimensional. It is difficult to achieve the high level of precision required by the processing, and the structural components of the valve operating mechanism experience torsion force when the valves are driven, which shortens their service life.

For a structure of a lubrication device for an OHV engine, there is a breather passage between the crankcase and the valve operating mechanism chamber which contains the valve operating mechanism. Oil which is taken up by a dipper, splashed about and suspended in the crankcase is conveyed via this breather passage into the aforesaid valve operating mechanism chamber with the movement of air caused by the downward stroke of the piston. In this way the said valve operating mechanism chamber is lubricated.

An example of an existing lubrication device for the valve operating mechanism in a small multipurpose OHV engine can be found in Japanese Utility Model Publication (Kokoku) 63-15530. The details of this device are shown in FIGS. 20 through 22.

These drawings show an OHV engine whose cylinder is canted upward from the horizontal. Breather passage 131, which connects crankcase 101 and valve operating mechanism chamber 102, is formed within the walls of cylinder barrel 116 and cylinder head 118.

The end portion 131*a* of the said breather passage 131 in valve operating mechanism chamber 102 faces from above intake valve 151 toward the point where valve stem 152*a* of exhaust valve 152 and rocker arm 162 come in contact. Branching passage 131*b* faces to the point where valve stem 151*a* of intake valve 151 and rocker arm 161 come in contact.

Because this OHV engine is configured in this prior art, the air which is moved by the downward stroke of piston 107 forces the oil picked up by dipper 115 and suspended in crankcase 101 into the aforesaid breather passage 131. The greater part of this suspended oil goes in a straight line through portion 131*a* and is splashed upon the operating mechanism for exhaust valve 152 in the vicinity of the point where valve stem 152*a* and rocker arm 162 come in contact. This is how most of the suspended oil is supplied.

The remainder of the suspended oil goes through branching passage 131*b* and is splashed upon the operating mechanism for intake valve 151 in the vicinity of the point where valve stem 151*a* and rocker arm 161 come in contact.

When the air forced into the aforesaid valve operating mechanism chamber 102 goes through breather valve 108, the lubricating oil is separated out. The air enters breather chamber 109, travels through breather tube 132 and is returned to carburetor 111. The oil flows down the interior surface of valve operating mechanism chamber 102. It goes through the space around push rod 122 and tappet 121 and is recovered in crankcase 101.

In this prior art OHV engine disclosed in the Japanese Utility Model Publication (Kokoku) 63-15530, as may be seen in FIG. 21, intake and exhaust valves 151 and 152 are parallel to each other, and the distance traveled by the aforesaid two valves, which protrude into valve operating mechanism chamber 102, is relatively short. Breather passage 131, which goes through the aforesaid crankcase 101 and valve operating mechanism chamber 102, is formed in the thick portion within the walls of cylinder barrel 117 and cylinder head 118.

In recent years, more and more pent roof combustion chambers have been used in OHV engines to increase combustion efficiency. In an engine with a pent roof combustion chamber, the intake and exhaust valves are canted at a given angle with respect to the axis of the cylinder barrel, with the open side of the angle toward the exterior. As a result, a large space must be provided at the front end of the intake and exhaust valves, where they protrude into the valve operating mechanism chamber for the operating mechanism. At the same time, every possible structural component has been made thinner in the interest of reducing the weight of the engine, and every possible space has been made smaller. With the prior art design, it has proved impossible to simplify the breather passage without increasing the parts count. With the current breather passage, the exhaust valve does not receive sufficient lubrication, which shortens the service life of the engine.

SUMMARY OF THE INVENTION

In view of the problems inherent in the prior art, our first objective in designing this invention is to provide an overhead-valve internal combustion engine with one intake and one exhaust valve which would have the following features. The surface in the cylinder head on which the rocker arm supporting base which supports the rocker arms is mounted and the surface on which the head cover sits can be formed on the same level. This configuration will be able to simplify the assembling process to mount the valve operating mechanism on the cylinder head. The number of production processes and assembly processes would be reduced, and the engine will be able to be made at a lower cost.

Our second objective in designing this invention is to provide a lubrication device for an overhead valve engine with a pent roof combustion chamber such that the breather passage in the valve operating mechanism chamber for the valve operating mechanism would be simplified without increasing the parts count so that a sufficient quantity of lubricating oil can be supplied to the entire valve operating mechanism.

In order to address the above objectives, we propose the following preferred embodiments according to this invention.

The first preferred embodiment of the invention is an overhead-valve internal combustion engine with a hemispherical or pent roof cylinder head. Such a head has a combustion chamber being formed with a curved top portion projecting upward. One intake valve and one exhaust valve are mounted symmetrically with respect to the axis of the cylinder shaft. The rocker arm supporting base which supports the rocker arms is fixed to the top of the aforesaid cylinder head. The rocker arm shaft is supported by the said base. The central portion of the rocker arms engages with the said rocker arm shaft in such a way that the arms are free to swing. The push rods and the aforesaid intake and exhaust valves are connected to the ends of the arms. The valve operating mechanism comprising the aforesaid intake and exhaust valves, the supporting base for the rocker arm shaft, and the rocker arms are enclosed in the head cover which is fixed to the top surface of the aforesaid cylinder head. This engine is distinguished by the fact that on the top surface of the aforesaid cylinder head, the surface for the rocker arm supporting base on which the aforesaid rocker shaft are mounted and that on which the head cover sits are coplanar. More specifically, either these two surfaces are coplanar or the surface of the rocker arm supporting base which is formed in the center of the cylinder head is slightly higher than the aforesaid surface on which the cover sits.

In another example of the first preferred embodiment of the invention, the aforesaid cylinder head in the overhead-valve internal combustion engine according to the first preferred embodiment ideally has a surface on which the head cover can sit which is formed on the top of the peripheral wall. The mounting surface of the aforesaid rocker arm supporting base is formed on two bosses which extend from the aforesaid peripheral wall toward the interior of the head.

According to these examples of the first preferred embodiment, the mounting surface of the cylinder head on which is mounted the rocker arm, the ancillary components such as the adjustment screws which are mounted on the said rocker arms, and the rocker arm supporting base to support the rocker arm shaft, is level with the top surface on the upper surface of the peripheral wall or the mounting surface positioned in the center of the cylinder head is same as, or slightly higher than, the top surface. This makes it possible to machine the two surfaces at the same time.

Thus there is no need for two-stage processing or changing tools during processing, as was the case with prior art designs. This design significantly reduces the number of processes required, and the simultaneous machining described above results in a highly planar surface, which translates into greater precision.

Yet in another example of the first preferred embodiment, the rocker arm supporting base according to the first embodiment is mounted in the center of the top of the aforesaid cylinder head. The aforesaid intake and exhaust valves are on either side of the said rocker arm supporting base. The aforesaid rocker arm shafts are supported at two places to the aforesaid rocker arm supporting base, and they are symmetrical with respect to the center of the cylinder.

One shaft is provided for the intake valve and one for the exhaust valve. The shafts are arranged so that they are parallel to each other within the base which is parallel to the mounting surface of the cylinder head. The aforesaid rocker arms are inserted into the shafts for the aforesaid intake and exhaust valves. The supporting portion of each rocker arm which is inserted into one of the aforesaid shafts is sandwiched between two arm units, the first arm unit which is engaged with one of the push rods and the second arm unit which pushes the intake valve.

With this configuration, the shafts for the two rocker arms are fixed to the rocker arm supporting base at both ends. This minimizes the torsion force which acts on the shafts when the rocker arms operate and allows us to achieve rocker arms and a shaft supporting mechanism with a high degree of strength.

In the second preferred embodiment of this invention, the aforesaid rocker arm supporting base according to the first embodiment is mounted to the center of the top of the aforesaid cylinder head. The aforesaid intake and exhaust valves are on both sides of the said rocker arm supporting base. The one end of the aforesaid rocker arm shafts in the center of the engine is supported by the aforesaid rocker arm supporting base. The shaft for the intake valve extends from the rocker arm supporting base at a right angle to the axis of the intake valve, and the shaft for the exhaust valve extends from the rocker arm supporting base at a right angle to the axis of the exhaust valve. Each of the aforesaid rocker arms has a central supporting portion which is inserted into one of the shafts. The supporting portion of each rocker arm which is inserted into one of the aforesaid shafts is sandwiched between two arm units, the first arm unit of which is engaged with one of the push rods and the second arm unit of which pushes the intake valve.

With this configuration, the rocker arm shafts are fixed to both sides of the rocker arm supporting base. This allows the rocker arm supporting base to be made smaller, and a smaller mounting surface on the cylinder head will suffice. As a result, fewer processes are required to produce the said mounting surface.

Furthermore, the rocker arms can be made longer so as to prevent the expenditure of unnecessary force in the valve operating mechanism.

In the third preferred embodiment of this invention, the axes of the aforesaid two rocker arm shafts according to the second preferred embodiment, when viewed from above, are at a fixed angle with respect to a line linking the axes of the aforesaid intake and exhaust valves, and they separate from each other more as they move away from the center.

With this configuration, the point at which the rocker arm is engaged with the push rod and the point at which it is in contact with the intake or exhaust valve are arranged in a straight line on either side of the axis of the rocker arm shaft.

In another example of the first preferred embodiment of this invention, an engine according to the first embodiment has a hemispherical or pent roof cylinder head with a combustion chamber being formed with a curved top portion projecting upward. One intake valve and one exhaust valve are mounted symmetrically with respect to the axis of the cylinder shaft. The rocker arm supporting base is fixed to the top of the aforesaid cylinder head. The rocker arm shafts are supported by the said rocker arm supporting base. The central portion of the rocker arms engages with the said rocker arm shafts in such a way that the arms are free to swing. The push rods and the aforesaid intake and exhaust valves are engaged with the ends of the arms. The aforesaid shafts and rocker arms are firstly mounted to the aforesaid rocker arm supporting base, then secondly the rocker arm supporting base can be mounted on the surface prepared for it in the aforesaid cylinder head.

According to this configuration, rocker arm shafts and rocker arms are assembled to the rocker arm supporting base as a unit, then the base is mounted on the mounting surface for the rocker arm supporting base. This makes the assembling process easier and reduces the assembling count.

The ideal manufacturing method for manufacturing an internal combustion engine according to this invention is proposed as the following two examples. A cylinder head is prepared which has a combustion chamber whose roof curves upward. The top surface of this head is formed in such a way that the mounting surface of the aforesaid rocker arm supporting base and the top surface on which the head cover sits are coplanar. An assembly component is prepared which comprises the rocker arm supporting base on which the shafts and the rocker arms have been mounted.

The assembly component which includes the rocker arms is fixed to the top of the aforesaid cylinder head. The intake and exhaust valves are mounted so that they are symmetrical with respect to the axis of the cylinder. The push rods and the aforesaid intake and exhaust valves are engaged, respectively, to the opposite ends of the aforesaid rocker arms.

According to the other example of the ideal manufacturing method, the manufacturing method of manufacturing an overhead-valve internal combustion engine is distinguished by the following. The intake and exhaust valves and push rods of the combustion chamber are mounted to the cylinder head. The rocker arms, rocker arm shafts, rocker arm supporting base, adjustment screws to adjust the gap between the valves and lock nuts are assembled as a unit, which is then mounted to the surface prepared for it, a surface which is virtually level with that on which the head cover sits. The head cover is then fixed to the cylinder head.

With these manufacturing methods mentioned above, the rocker arm shafts, the rocker arms and their ancillary components are all mounted on the rocker arm supporting base to form a unit, which is then mounted to the cylinder head. This procedure simplifies the assembly and adjustment of the valve operating mechanism and reduces the number of procedures required.

The fourth preferred embodiment is for the lubrication device for OHV engine.

According to the fourth preferred embodiment of this invention, a lubrication device for overhead-valve engine having a first breather passage connecting a valve operation mechanism chamber over a cylinder head provided with an intake valve and an exhaust valve, and a crankcase, and passing through said cylinder head and a cylinder, comprises an opening of a first breather passage, a groove, and a second breather passage.

The opening of the first breather passage is provided in a vicinity of a spring retainer for the intake valve, which faces the valve operating mechanism chamber.

The groove is formed by cutting on the cylinder head facing the valve operating chamber and connecting an end of the groove to the opening.

The second breather passage is formed by a tunnel-like passage provided by a guide wall standing in the valve operating mechanism chamber and a peripheral wall of said cylinder head and connecting another end of said groove to the exhaust valve.

According to another example of the fourth preferred embodiment, the second breather passage mentioned above is further comprises a protruding portion of a gasket provided between a top surface of the cylinder head and a head cover, which covers the tunnel-like passage.

According to yet another example of the fourth preferred embodiment, the second breather passage connects spaces surrounded with ring-shaped ribs which protrude from spring retainers for an intake valve spring and an exhaust valve spring by the groove formed by cutting on a portion of the ring-shaped rib and the tunnel-like passage.

With this fourth preferred embodiment of the invention, the lubricating oil splashed around in the crankcase goes through the first breather passage and flows out through the opening of the valve operating mechanism chamber in the vicinity of the spring retainer for the intake valve. From the vicinity of the said intake valve, the oil goes through the second breather passage, which comprises a groove formed on the valve operating mechanism chamber surface of the cylinder head and a tunnel surrounded by a guide wall and the peripheral wall of the cylinder head. This passage conducts the oil to the vicinity of the exhaust valve.

With this fourth preferred embodiment of the invention, a sufficient quantity of lubricating oil can be supplied not only to the area around the intake valve, but also, via the second breather passage, to the area around the exhaust valve, where extreme temperatures are experienced. The entire valve operating mechanism can be lubricated uniformly.

Because the aforesaid second breather passage can be created using the valve operating mechanism chamber surface of the cylinder head and the protruding portion of the gasket, no special parts need to be purchased or made, and the parts count can be reduced.

The effects of this invention related to the structure of the cylinder head according the first through third preferred embodiments of this invention are as follows. In these configurations mentioned above, the mounting surface of the cylinder head on which Is mounted the rocker arm, and the rocker arm supporting base to support the rocker arm shaft, is level with the top surface on the upper surface of the peripheral wall, or the mounting surface positioned in the center of the cylinder head is slightly higher than the top surface. This makes it possible to machine the two surfaces at the same time.

Thus there is no need for two-stage processing or changing tools during processing, as was the case with prior art designs. This design significantly reduces the number of processes required; and the simultaneous machining described above results in a highly planar surface, which translates into greater precision.

With the configuration according to the example of the first preferred embodiment mentioned above, the shafts for the two rocker arms are fixed to the rocker arm supporting base at both ends, in other words, the shafts are supported at both ends. This minimizes the torsion force which acts on the shafts when the rocker arms operate and allows us to achieve rocker arms and a shaft supporting mechanism with a high degree of strength.

With the configuration according to the second preferred embodiment mentioned above, the rocker arm shafts are fixed at one end. This allows the rocker arm supporting base to be made smaller, and a smaller mounting surface on the cylinder head will suffice. As a result, fewer processes are required to produce the said mounting surface.

Furthermore, the rocker arms can be made longer so as to prevent the expenditure of unnecessary force in the valve operating mechanism, and the durability of the valve operating mechanism can be enhanced.

With the configuration according to the third preferred embodiment, the point at which the rocker arm is engaged with the push rod and the point at which it is in contact with the intake or exhaust valve are arranged in a straight line on either side of the axis of the rocker arm shaft.

With the manufacturing method mentioned above, the rocker arm shafts, the rocker arms and their ancillary components are all mounted on the rocker arm supporting base to form a unit, which is then mounted to the cylinder head. This procedure simplifies the assembly and adjustment of the valve operating mechanism and reduces the number of procedures required.

The mounting surface of the cylinder head on which is mounted the rocker arm, and the rocker arm supporting base to support the rocker arm shaft, is level with the top surface on the upper surface of the peripheral wall, or the mounting surface positioned in the center of the cylinder head is slightly higher than the top surface. This makes it possible to machine the two surfaces at the same time.

Thus there is no need for two-stage processing or changing tools during processing, as was the case with prior art designs. This design significantly reduces the number of processes required; and the simultaneous machining described above results in a highly planar surface, which translates into greater precision.

The effects of the invention related to the lubrication device according the fourth preferred embodiment are as follows. In these configurations of this invention, the lubricating oil splashed around in the crankcase goes through the opening in the vicinity of the spring retainer for intake valve. From the vicinity of the said intake valve, the suspended oil goes through the second breather-passage formed by a groove and a tunnel which is surrounded by a straight guide wall and the peripheral wall of the cylinder head. This passage conducts the suspended oil to the vicinity of the exhaust valve. In this fashion, a sufficient quantity of lubricating oil can be supplied not only to the area around the intake valve, but also to the area around the exhaust valve, where extreme temperatures are experienced. The entire valve operating mechanism can be lubricated uniformly.

Because the aforesaid breather passage can be created using the valve operating mechanism chamber surface of the cylinder head and the entrance portion of the oil guide washer plate, no special parts need to be used, and it is easy to assemble the valve operating mechanism chamber. In other words, the parts count can be reduced, and the entire valve operating mechanism can be lubricated perfectly with a low cost.

DETAILED DESCRIPTION OF THE INVENTION

Figure 1:
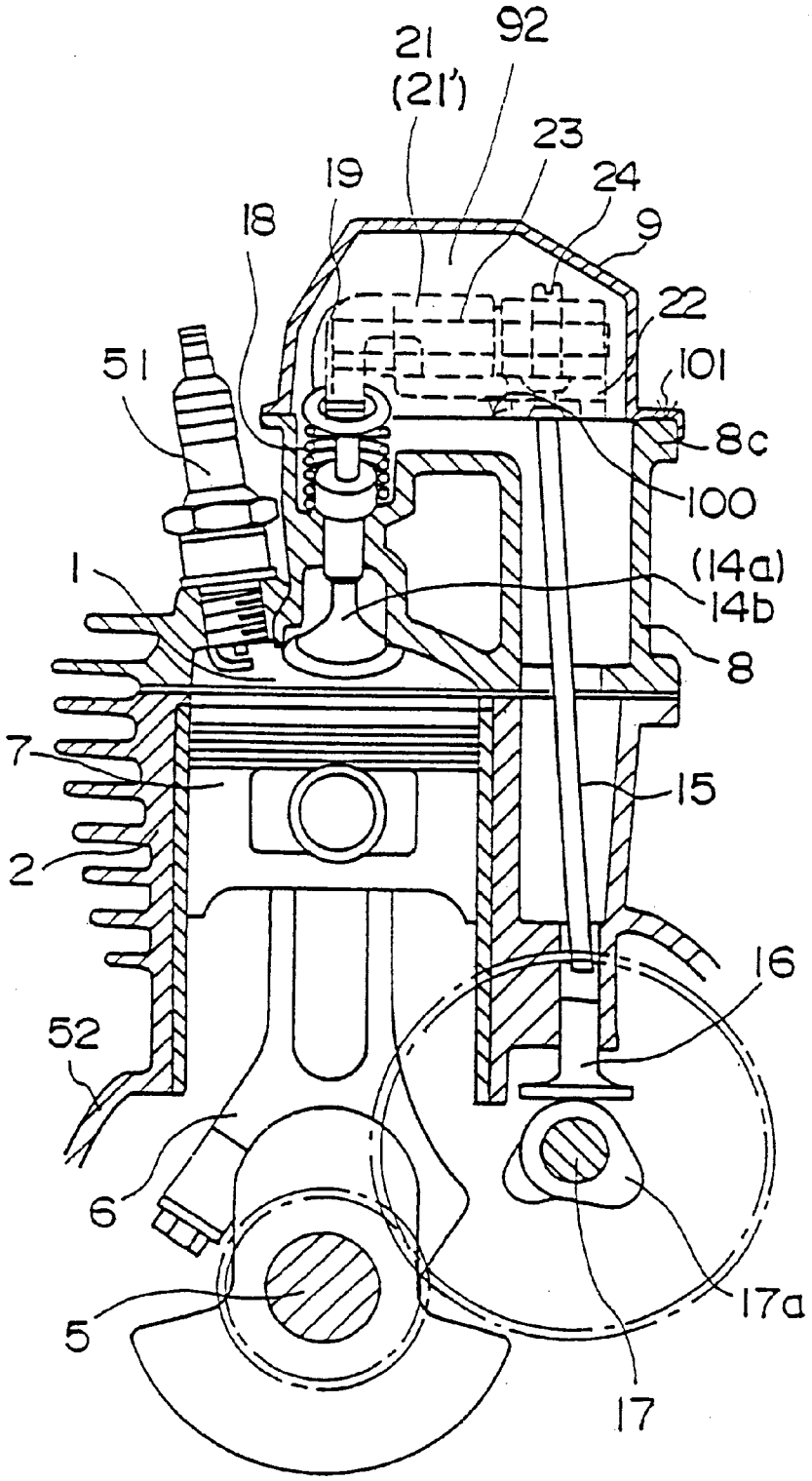
FIG. 1 is a cross section of an air-cooled overhead-valve single cylinder four-cycle internal combustion engine which is the first configuration of this invention. This drawing shows primarily the cylinder and the push rod.

In this section we shall give a detailed explanation of several preferred embodiments of this invention with reference to the example configurations pictured in the drawings. To the extent that the dimensions, materials, shape and relative position of the components described in this configuration are not definitely fixed, the scope of the invention is not limited to those specified, which are meant to serve merely as illustrative examples.

Figure 2:
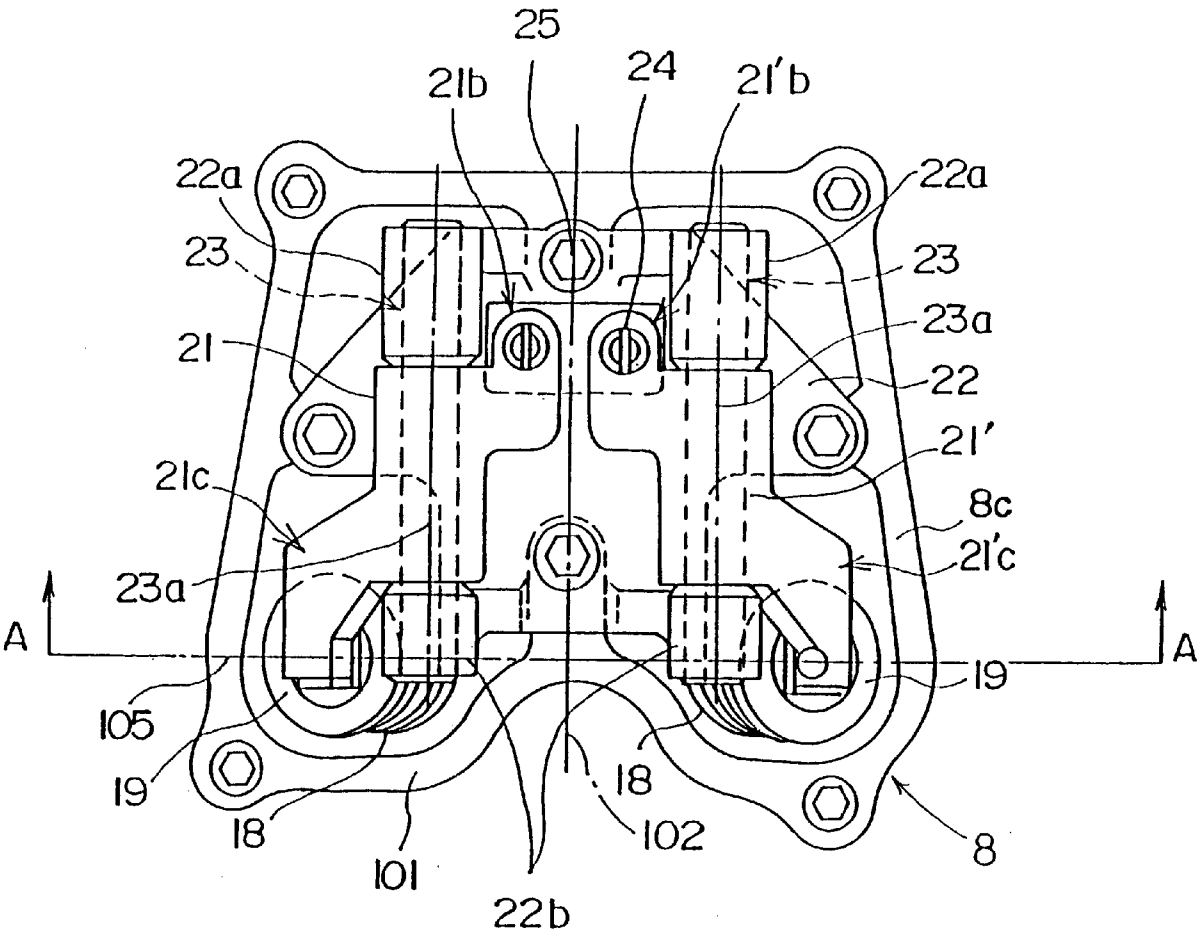
FIG. 2 is a plan view of the engine in FIG. 1 with the head cover removed.
Figure 3:
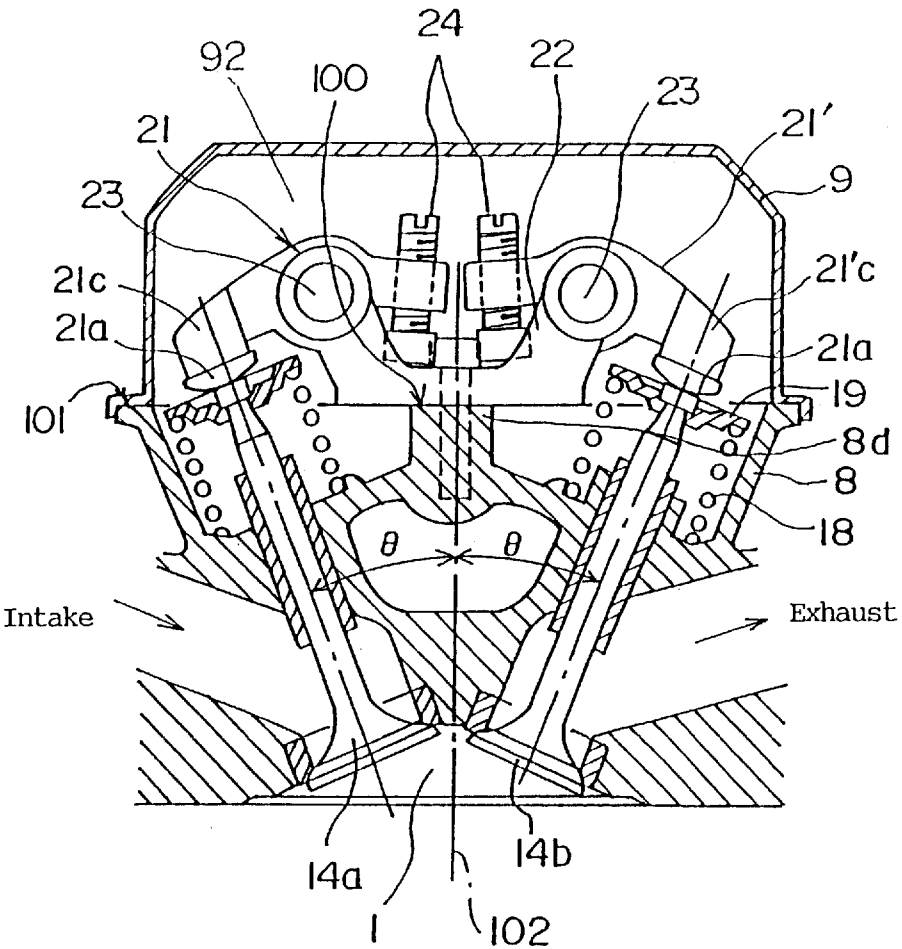
FIG. 3 is a cross section taken along line A—A in FIG. 2.

FIG. 1 is a cross section of an air-cooled overhead-valve single cylinder four-cycle internal combustion engine which is the first preferred embodiment of this invention. This drawing shows primarily the cylinder and the push rod. FIG. 2 is a plan view of the engine in FIG. 1 with the head cover removed. FIG. 3 is a cross section taken along line A—A in FIG. 2.

In FIGS. 1 through 3, 1 is the combustion chamber; 2 is the air-cooled cylinder; 5 is the crankshaft; 6 is the connecting rod; 7 is the piston; 8 is the cylinder head; 14*a* is the intake valve; 14*b* is the exhaust valve (hereafter, intake valve 14*a* and exhaust valve 14*b* are known collectively as induction/exhaust valves 14); 51 is the spark plug; and 52 is the crankcase.

17 is the camshaft, which is connected to crankshaft 5 through a gear train; 17*a* is the cam formed on the said camshaft 17; 16 is the tappet; 15 is the push rod; 18 are the valve springs for the aforesaid induction/exhaust valves 14; 19 are the spring bearings which support the said valve springs 18. 9 is the head cover, which encloses the valve operating mechanism (to be discussed shortly). This cover is mounted on top surface 101 of peripheral wall 8*c*, which surrounds the aforesaid cylinder head 8.

The aforesaid combustion chamber 1 is a pent roof-type chamber. This is why, as can be seen in FIG. 3, the aforesaid intake valve 14*a* and exhaust valve 14*b* are arranged so that their respective axes 103 and 104 angle away from the center line 102 of the cylinder. That is to say, the valves incline with respect to the center line at angle in the fashion of radiating lines.

This angle θ is such that θ=22° to 45°. Ideally, it should be in the neighborhood of 45°.

21 is the rocker arm for the intake valve. 21' is the rocker arm for the exhaust valve. It is placed on the opposite side of center line 102 so that it is symmetrical with respect to the said rocker arm 21. 23 are the rocker arm shafts, and 22 is the rocker arm supporting base. The aforesaid rocker arms 21 and 21', rocker arm shafts 23, rocker arm supporting base 22, cam 17*a*, tappet 16 and push rod 15 comprise the valve operating mechanism. 92 is the valve operating mechanism chamber to install the valve operating mechanism, and it is covered by the head cover 9.

As can be seen in FIG. 2 and FIG. 3, the aforesaid rocker arm supporting base 22 is fixed by four bolts 25 to mounting surfaces 100, the upper surfaces of the four-bosses 8*d* which project from peripheral wall 8*c* of cylinder head 8 toward the center of the head. At the ends of the rocker arm supporting base are four retainers 22*a* and 22*b*, which support the two rocker arms 23 for the aforesaid intake and exhaust valves at both their ends. These retainers also immobilize the two rocker arm shafts 23 so that they are parallel to each other.

Furthermore, as can be seen in FIG. 2, the aforesaid rocker arm shafts 23 are mounted onto the aforesaid rocker arm supporting base 22 so that their axes 23*a* are at a right angle with respect to line 105, the line which links the centers of intake valve 14*a* and exhaust valve 14*b*.

As is shown in FIG. 2, the central tubular portions of rocker arm 21, which controls the aforesaid intake valve, and rocker arm 21', which controls the exhaust valve, are supported by the aforesaid rocker arm shafts 23 in such a way that the rocker arms are free to swing and their movement in the axial direction can be controlled. Shafts 23 must have a diameter large enough to provide a sufficient bearing area. 21*b* and 21'*b* are the first arm units on the ends of the arms which come in contact with push rods 15 in the axial direction of the aforesaid arms 23. 21*c* and 21'*c* are the second arm units on the ends of the arms which come in contact with intake valve 14*a* and exhaust valve 14*b*.

Adjustment screws 24, which serve to adjust the clearance of the valve operating mechanism, are screwed into the aforesaid arm units 21*b* and 21'*b*. On the end of each adjustment screw 24 is a spherical bearing. The push rods 15 for the aforesaid intake and exhaust valves are linked to the rocker arms through these bearings. The aforesaid rocker arm units 21*c* and 21'*c* contact with intake valve 14*a* and exhaust valve 14*b* through straps 21*a*, which are made from a material that is highly resistant to being worn away. Mounting surface 100 for rocker arm supporting base 22 on the upper surface of cylinder head 8 is coplanar (unifacial) with top surface 101, on which head cover 9 is mounted.

Ideally, the aforesaid mounting surface 100 and top surface 101 should be on the same plane. However, it would also be acceptable for them to be at slightly different levels. In this case, for the purpose of machining the surfaces, it would be better if the aforesaid top surface 101, which is on the outside of the head, could be slightly lower than the mounting surface 100, which is in the interior.

When this OHV engine is operating, induction/exhaust valves 14 open and close according to a timing determined by camshaft 17, whose rotating speed is reduced to half that of crankshaft 5 by a timing gear (not pictured). That is to say, when camshaft 17 rotates, push rods 15 are thrust upward, and rocker arm 21, which operates the intake valve, or rocker arm 21', which operates the exhaust valve, rotates around shaft 23. Intake valve 14*a* or exhaust valve 14*b* is pushed upward against the elastic force of its respective valve spring 18, and the valve opens.

In an OHV engine like this, to insure that the action of cam 17*a* is transmitted reliably to induction/exhaust valve 14 through push rods 15, the aforesaid valve springs 18 must have a relatively large spring constant, meaning that strong springs must be used; and, as was mentioned above, rocker arms 23 must have a relatively large diameter.

The upper surface of cylinder head 8, on which is mounted rocker arm supporting base 22, the base which supports the mechanism in cylinder head 8 that executes this operation, serves as mounting surface 100. As was discussed earlier, this mounting surface is coplanar with top surface 101, on which the head cover is mounted. This means that the two surfaces, 100 and 101, can be finished together in the same machining process. There is no need, as was true in the prior art, to use a two-stage process or to change tools. In this first preferred embodiment, shafts 23 are fixed to rocker arm supporting base 22, and rocker arm 21, which operates the intake valve, and rocker arm 21', which operates the exhaust valve, are inserted into the shafts with adjustment screw 24 already screwed in. Once this unit is assembled, it can be mounted to cylinder head 8. This procedure simplifies both the assembly and the adjustment of the valve operating mechanism.

In this first preferred embodiment, rocker arm shafts 23 for the intake and exhaust valves are supported in two places by retainers 22*a* and 22*b* of rocker arm supporting base 22. This minimizes the torsion force which acts on the shafts when the rocker arms operate and allows us to achieve rocker arms and a shaft support mechanism with a high degree of strength.

In the following second preferred embodiment, the structure of the rocker arm supporting base, and the rocker arm shaft are different from those of the first preferred embodiment.

In FIGS. 4 through 6, 27 is the rocker arm supporting base; it is fixed to mounting surface 100 by means of two bolts 25 at bosses 8*d*, which project from peripheral wall 8*c* of cylinder head 8 toward the interior of the head at a right angle to line 105, the line which links the centers of the aforesaid intake valve 14*a* and exhaust valve 14*b* to the center line 102 of the cylinder.

Just as in the first preferred embodiment, mounting surface 100 of the aforesaid rocker arm supporting base 27 is either coplanar with top surface 101 on which head cover 9 is mounted or slightly higher than that top surface.

Figure 4:
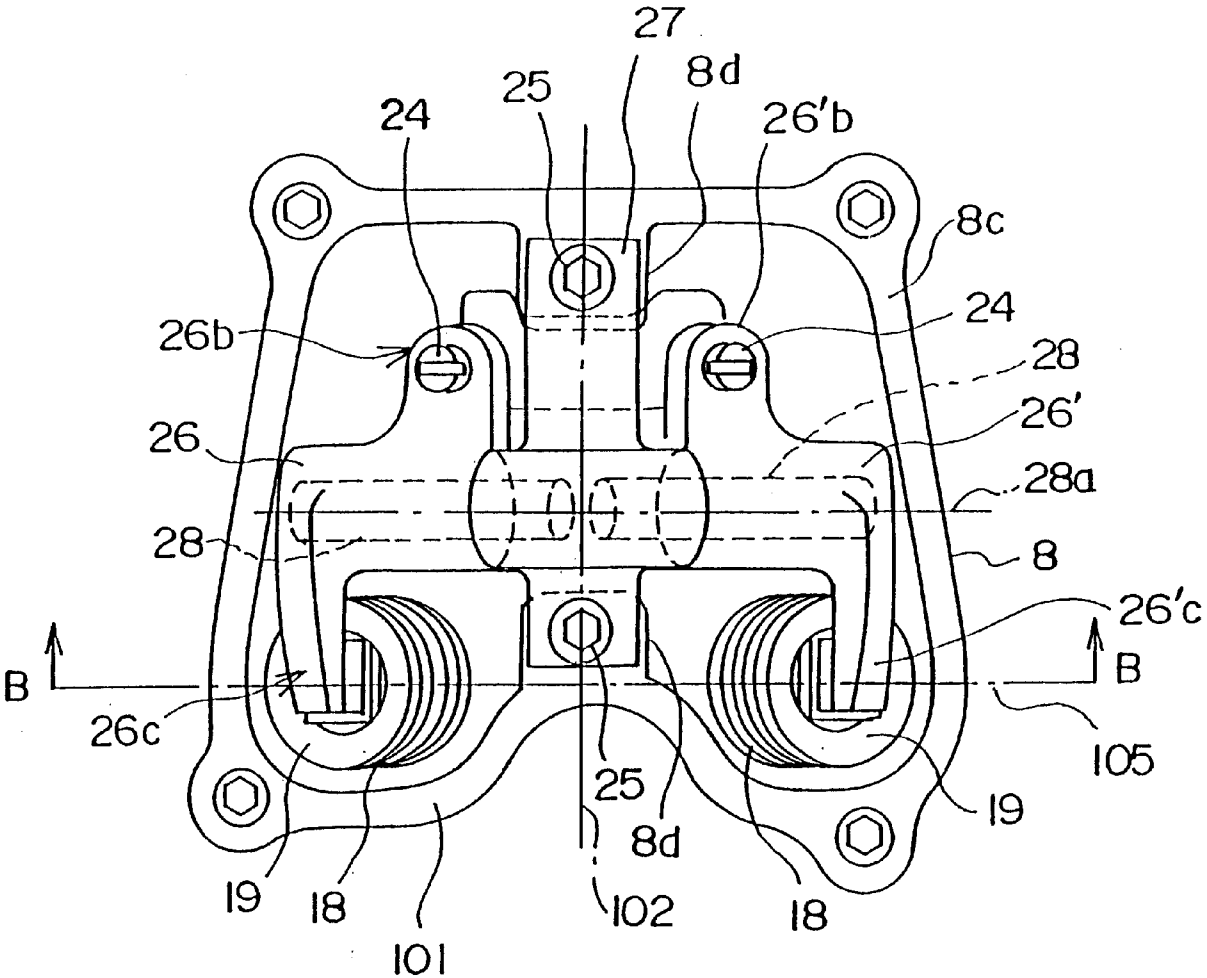
FIG. 4 corresponds to FIG. 2, which shows the second configuration of the second preferred embodiment of this invention.

28 are the rocker arm shafts. As can be seen in FIG. 4, their axes 28*a* when viewed from above are arranged so that they are virtually parallel to line 105, the line linking the centers of the aforesaid intake and exhaust valves 14*a* and 14*b*. The inner ends of the shafts are fixed to the aforesaid rocker arm supporting base 27; they are supported at only one end.

Figure 5:
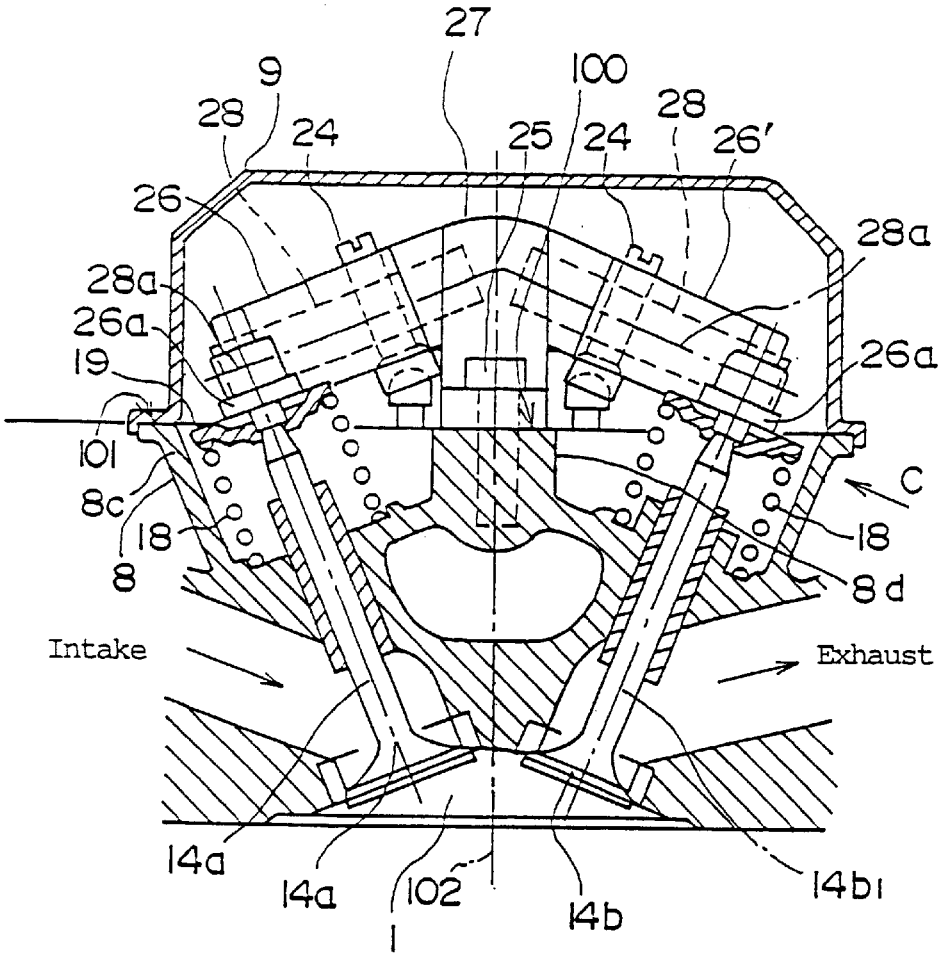
FIG. 5 is a cross section taken along line B—B in FIG. 4.
Figure 6:
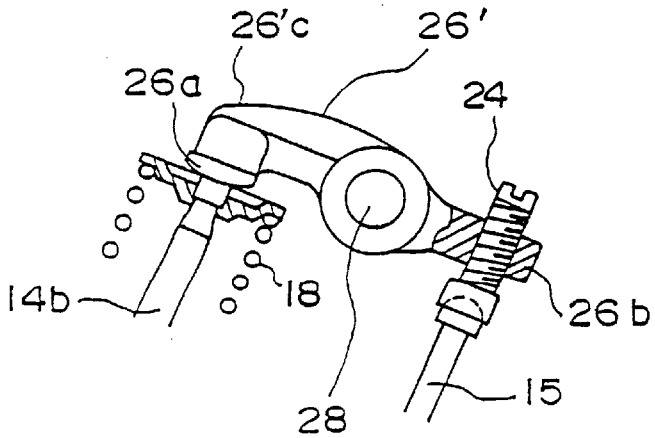
FIG. 6 is the view of the cylinder head in FIG. 5 as seen from arrow C in that figure (when seen through the valve operating mechanism).

The aforesaid rocker arm shafts 28 are arranged so as to have an inclining angle with respect to the center line 102 of the cylinder, as can be seen in FIG. 5. In this preferred embodiment, their axes 28*a* can form right angles with respect to the center lines $\mathbf{14}a_1$ and $\mathbf{14}b_1$ of intake and exhaust valves 14*a* and 14*b*, which are arranged to the radiate direction with respect to the center line 102 of the cylinder head.

26 is the rocker arm for the intake valve; 26' is the rocker arm for the exhaust valve. They are arranged symmetrically with respect to the center line 102 of the cylinder. The tubular portions in their centers are inserted into the aforesaid rocker arm shafts 28 in such a way that the arms are free to swing and their movement in the axial direction can be controlled.

The aforesaid axes 28*a* of rocker arm shafts 28 are surrounded by the aforesaid rocker arm 26 for the intake valve and 271 for the exhaust valve. Their ends 26*b* and 26'*b* come in contact with push rods 15. Their other ends, 26*c* and 26'*c*, come in contact with intake valve 14*a* and exhaust valve 14*b*.

Adjustment screws 24 on ends 26*b* and 26'*b* are used to adjust the clearance of the valve operating mechanism. The rocker arms are engaged with push rods 15 through the spherical bearings on the ends of the adjustment screws.

The aforesaid ends 26*c* and 26'*c* are in contact with intake valve 14*a* and exhaust valve 14*b* through straps 26*a*.

All other aspects of the configuration are identical to that of the first preferred embodiment shown in FIGS. 1 through 3. Components which are the same have been given the same numbers.

In this second preferred embodiment, just as in the aforesaid first preferred embodiment, mounting surface 100 for the rocker arm supporting base on the top of cylinder head 8 is either coplanar with top surface 101 on top of peripheral wall 8*c*, to which head cover 9 is mounted, or slightly higher than that top surface. This design means that the two surfaces can be processed in a single stage, and the number of required processes is reduced. In addition, rocker arm supporting base 27 is smaller and the area of the said mounting surface 100 can be smaller than in the aforesaid first preferred embodiment. This further simplifies the processing of the said mounting surface 100 and reduces the number of processes.

In regard to configuration, the length of rocker arms 26 and 26' can be increased, which provides some leeway in the design of the valve operating mechanism and prevents excessive force from being exerted in that mechanism.

Figure 7:
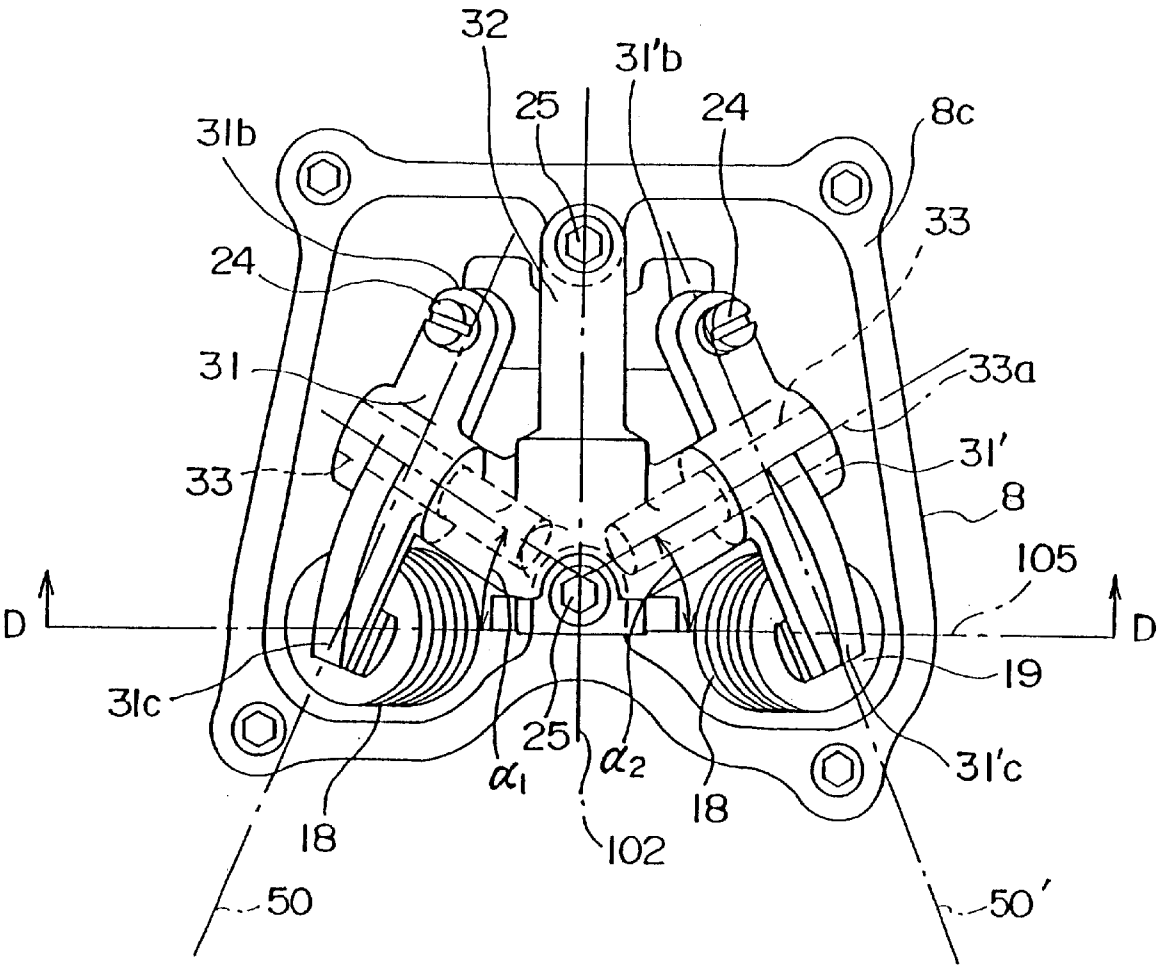
FIG. 7 corresponds to FIG. 2 but shows the third preferred embodiment of this invention.
Figure 8:
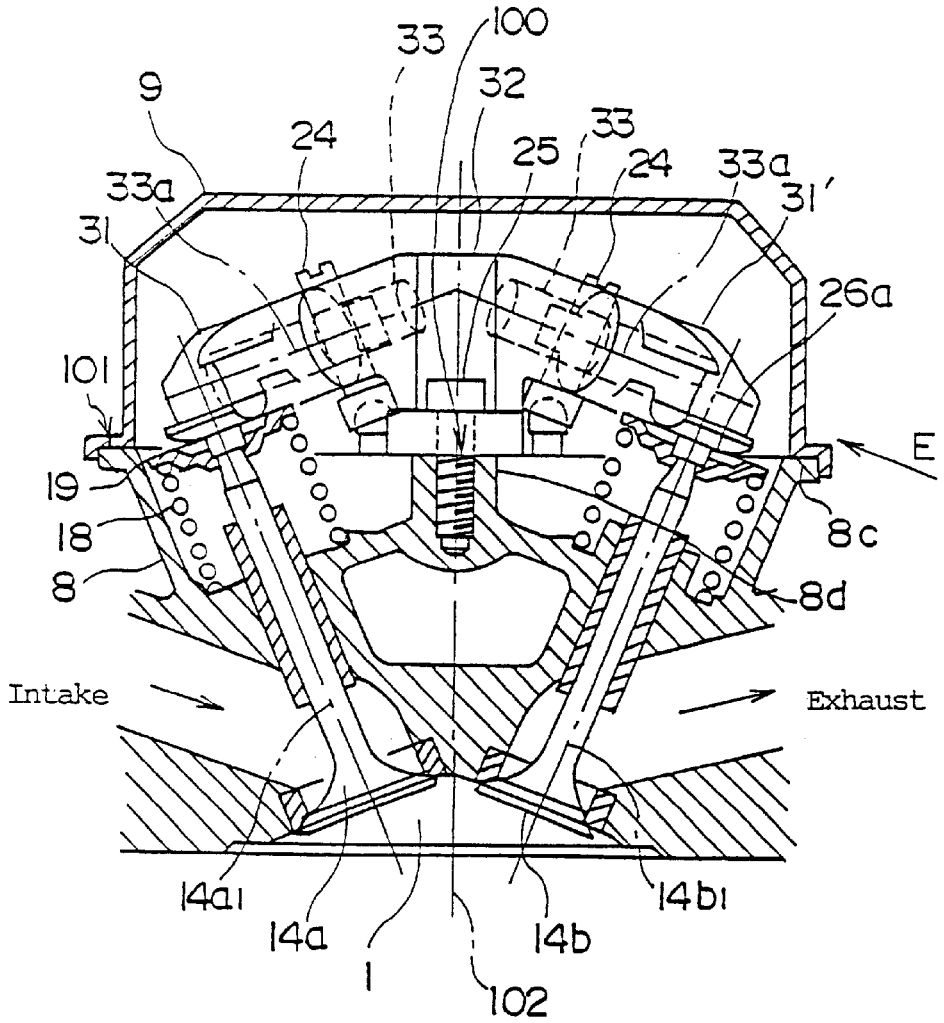
FIG. 8 is a cross section taken along line D—D in FIG. 7.
Figure 9:
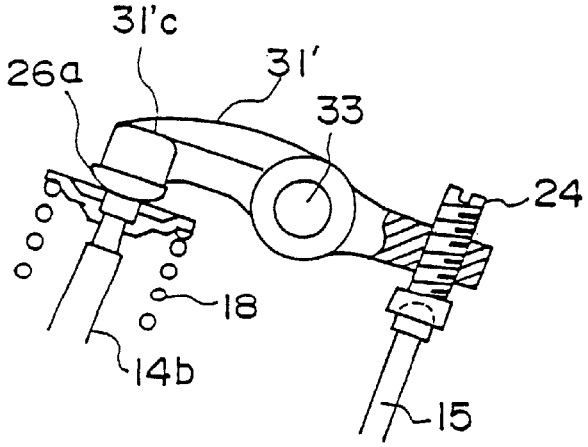
FIG. 9 is a view of the same cylinder head as seen from arrow E in FIG. 8 (when seen through the valve operating mechanism).

FIGS. 7 through 9 show the third preferred embodiment of this invention. FIG. 7 is a plan view which corresponds to FIG. 2. FIG. 8 is a cross section taken along line D—D in FIG. 7. FIG. 9 is a view of the same cylinder head as seen from arrow E in FIG. 8.

This preferred embodiment is a modification of the previous second one; the arrangement of the rocker arm supporting base and shafts differs from that in the second preferred embodiment.

In FIGS. 7 through 9, 32 is the rocker arm supporting base; it is fixed to mounting surface 100 by means of two bolts 25 on bosses 8*d*, which project from peripheral wall 8*c* of cylinder head 8 toward the interior of the head at a right angle to line 105, the line which links the centers of the aforesaid intake valve 14*a* and exhaust valve 14*b* to the center line 102 of the cylinder. As in the first two preferred embodiments, mounting surface 100 of the aforesaid rocker arm supporting base 32 is either coplanar with top surface 101 on which head cover 9 is mounted or slightly higher than that top surface.

33 are the rocker arm shafts. As can be seen in FIG. 7, their axes 33*a*, when viewed from above, are arranged so that they incline from the center to the exterior to form angles $\alpha_1$ and $\alpha_2$ with respect to line 105, the line linking the centers of the aforesaid intake and exhaust valves 14*a* and 14*b*. The inner ends of the shafts are fixed to the aforesaid rocker arm supporting base 32; the shafts are supported at only one end.

As can be seen in FIG. 8, when viewed in the same plane as center line 102, axes 33*a* of the aforesaid rocker arm shafts 33 form virtually right angles with axes 14*a*$_1$ and 14*b*$_1$of intake valve 14*a* and exhaust valve 14*b*.

31 is the rocker arm for the intake valve; 31' is the rocker arm for the exhaust valve. They are arranged symmetrically with respect to the center line 102 of the cylinder. The tubular portions in their centers are inserted into the aforesaid rocker arm shafts 33 in such a way that the arms are free to swing and their movement in the axial direction can be controlled.

The aforesaid axes 33*a* of rocker arm shafts 33 are surrounded by the aforesaid rocker arm 31 for the intake valve and 31' for the exhaust valve. Their ends 31*b* and 31'*b* come in contact with push rods 15. Their other ends, 31*c* and 31'*c*, come in contact with intake valve 14*a* and exhaust-valve 14*b*.

Adjustment screws 24 on ends 31*b* and 31'*b* are used to adjust the clearance of the valve operating mechanism. The rocker arms are engaged with push rods 15 through the spherical bearings on the ends of the adjustment screws.

The aforesaid ends 31*c* and 31'*c* are in contact with intake valve 14*a* and exhaust valve 14*b* through straps 26*a*. All other aspects of the configuration are identical to that of the second preferred embodiment shown in FIGS. 4 through 6. Components which are the same have been given the same numbers.

In this preferred embodiment, just as in the aforesaid first and second preferred embodiments, mounting surface 100 for the locker arm supporting base on the top of cylinder head 8 is either coplanar with top surface 101 on top of peripheral wall 8*c*, to which head cover 9 is mounted, or slightly higher than that top surface. This design means that the two surfaces can be processed in a single stage, and the number of required processes is reduced.

In addition, just as in the aforesaid second preferred embodiment, rocker arm supporting base 32 is smaller and the area of the said mounting surface 100 can be smaller than in the aforesaid first preferred embodiment. Rocker arms 31 and 31' can be made smaller, and the processing of the said mounting surface 100 is further simplified. In regard to configuration, the length of rocker arms 31 and 31' can be increased, which prevents excessive force from being exerted in the valve operating mechanism.

Furthermore, in this third preferred embodiment, axes 33*a* of rocker arm shafts 33 are inclined at angles $\alpha_1$ and $\alpha_2$. The points at which ends 31*b* and 31'*b* of the arms for valves 14*a* and 14*b* are engaged with push rods 15 (i.e., the centers of adjustment screws 24) and the points at which ends 31*c* and 31'*c* are in contact with the heads of valves 14*a* and 14*b* (i.e., the centers of straps 26*a*) fall on lines 50 and 50', as can be seen in FIG. 7. There is no deviation along axes 33*a* of the rocker arm shafts between the aforesaid points where the arms are engaged with the push rods and the points where they are in contact with the valves. Thus there is no moment generated in rocker arms 31 and 31', and no excessive force experienced by the rocker arms due to moment.

Figure 10:
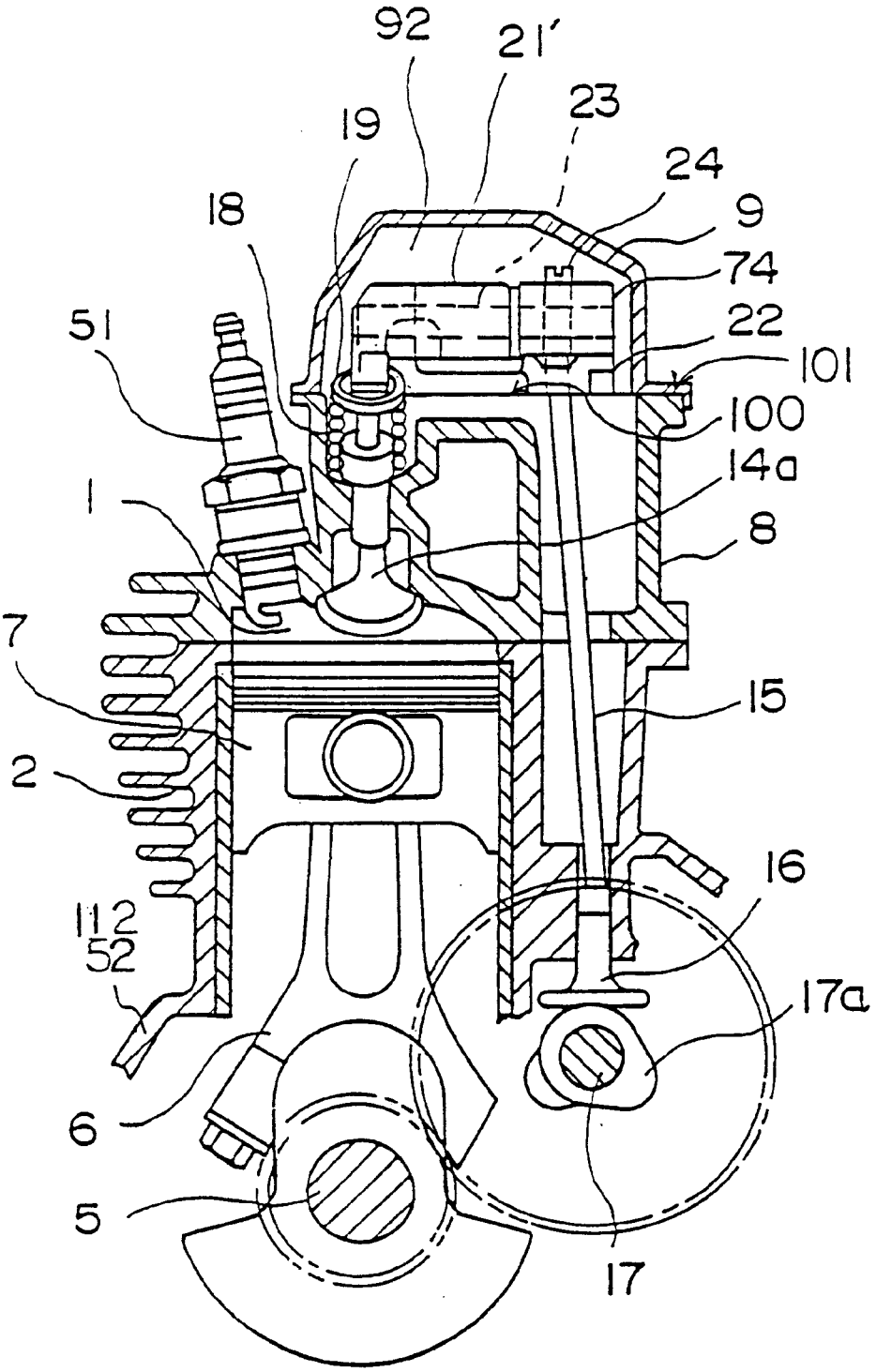
FIG. 10 corresponds to FIG. 1 and shows an air-cooled overhead-valve four-cycle internal combustion engine which is an example of the fourth preferred embodiment of this invention. This shows the cross section showing the center of the cylinder and the push rod.
Figure 11:
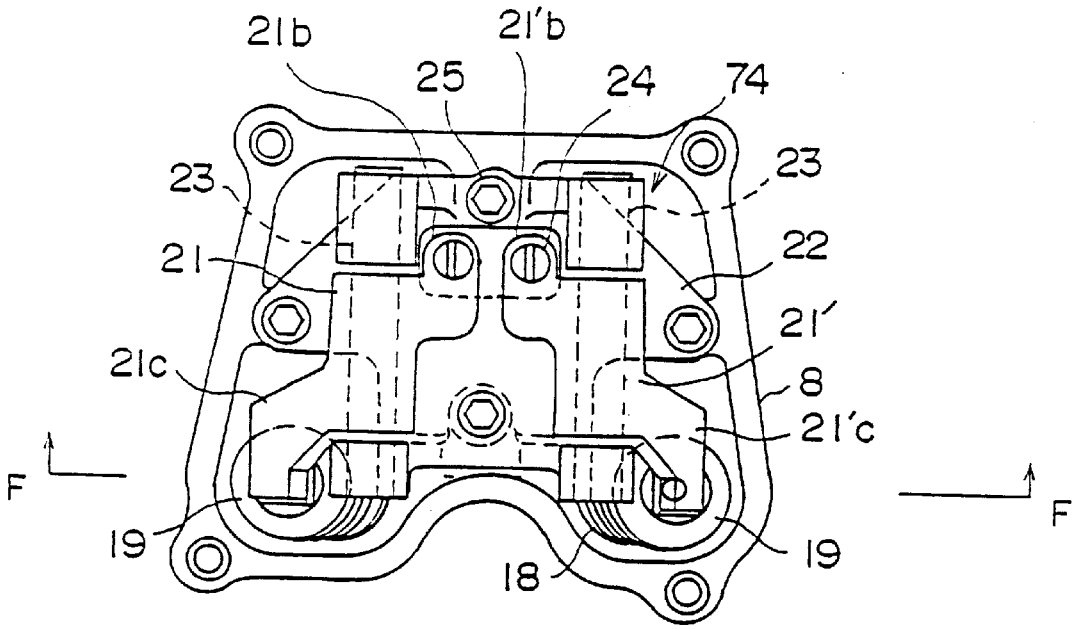
FIG. 11 is a plan view of the valve operating mechanism from the engine in FIG. 1 with the head cover removed according to the fourth preferred embodiment of this invention.

We shall explain the fourth preferred embodiment of this invention in detail with reference of FIG. 10 through FIG. 17. This fourth preferred embodiment is a modification on the lubrication device for the overhead combustion engine (OHV engine) shown in the first through third preferred embodiments. The OHV engine which this fourth preferred embodiment of the invention is applied is shown in FIG. 10.

As can be seen in FIG. 10, the multipurpose four-cycle OHV engine in which this fourth preferred embodiment of the invention is employed has a cylinder head 8 with a pent-roof combustion chamber 1, in which one intake valve 14*a* and one exhaust valve 14*b* are arranged so that their center lines radiate symmetrically.

In FIGS. 10 through 12, 2 is the cylinder; 5 is the crankshaft; 6 is the connecting rod; 7 is the piston; 8 is an aluminum die cast cylinder head with a pent-roof combustion chamber 1. 9 is the head cover, which is mounted on top surface of the said cylinder head 8. 14 and 14*a* are the intake and exhaust valves, arranged symmetrically in radiating fashion in the aforesaid cylinder head 8.

15 are the push rods; 32 is the push rod chamber for the push rods; 16 are the tappets; 18 are the valve springs for the aforesaid intake and exhaust valves 14*a* and 14*b*; 19 are the spring retainers which transmit to the aforesaid intake and exhaust valves 14 and 14*a* the force of the said valve springs 18; 21 is the rocker arm for the intake valve; 21' is the rocker arm for the exhaust valve, which is arranged so that it is symmetric with the aforesaid rocker arm 21; 22 is the rocker arm supporting base which supports the rocker arm shafts; 23 are two parallel rocker arm shafts. Valve operating mechanism 74 comprises components 14, 14*a*, 15, 16, 18, 19, 21, 21', 22, 23 and cams 17*a*.

The aforesaid rocker arm supporting base 22 is mounted to cylinder head 8 by means of four bolts 25. The aforesaid parallel rocker arm shafts 23 are supported at two points in the axial direction. Tubular rocker arm 21, the arm for the intake valve, and rocker arm 21', the arm for the exhaust valve, are fixed along their axes to the aforesaid rocker arm shafts 23 so that they are symmetric with respect to the axes of the shafts and they are free to rotate. On one end of the aforesaid rocker arms 21 and 21' are first arms 21*b* and 21'*b*, which are pushed by the aforesaid push rods 15. On the other end are second arms 21*c* and 21'*c*, which operate intake and exhaust valves 14*a* and 14*b*.

Adjusting screws 24, which are used to adjust the clearance of valve operating mechanism 74, are screwed into the ends of the aforesaid second arms 21*c* and 21'*c*. On the ends of the said screws 24 are spherical bearings (not pictured) which receive the spherical ends of the aforesaid push rods 15. Hemispherical washers 21*a* which are made of a material highly resistant to be worn away, are mounted on the ends of the aforesaid arms 21*c* and 21'*c* which come in contact with the aforesaid intake and exhaust valves 14*a* and 14*b*.

Figure 12:
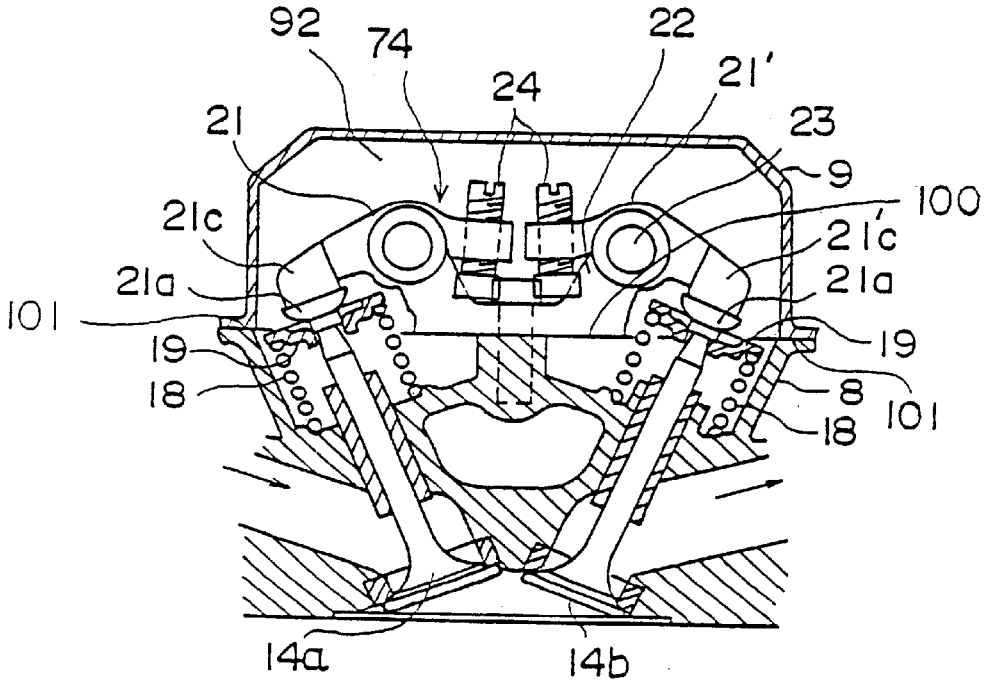
FIG. 12 is a cross section taken along line F—F in FIG. 11.
Figure 13:
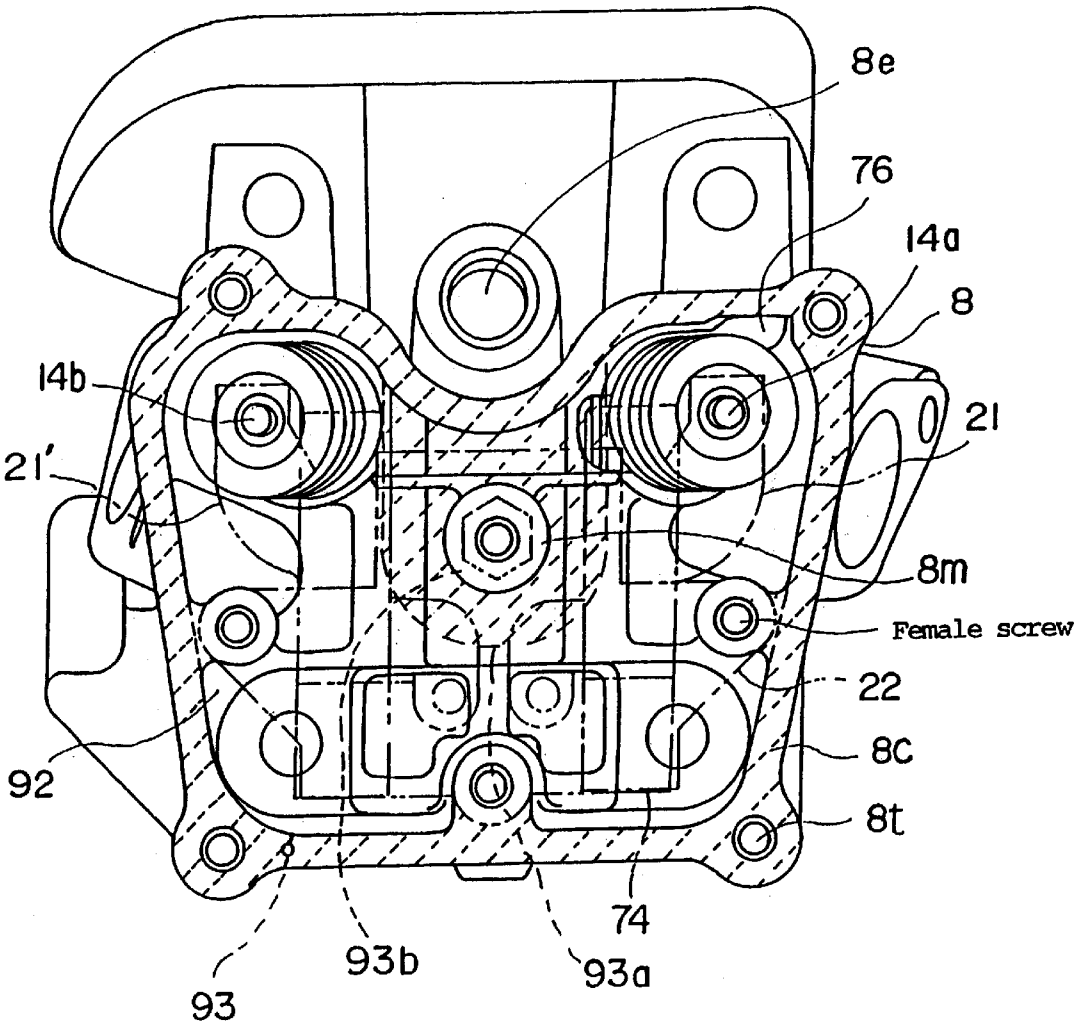
FIG. 13 shows a plan view of the valve operating mechanism in a multipurpose OHV engine which is the fourth preferred embodiment of this invention. The head cover has been removed.

The mounting surface of the aforesaid cylinder head 8 on which the aforesaid rocker arm supporting base 22 for the rocker arm shafts is mounted and the top surface on which head cover 9 is mounted, which are identified in FIG. 12, are coplanar. In other words, they constitute a single surface.

When this OHV engine runs, the aforesaid valve operating mechanism 74 works in the following way. The rotational speed of crankshaft 5 is reduced by half by a timing gear (not pictured) and transmitted to camshaft 17, on which cam 17*a* is mounted. With the help of tappets 16, push rods 15 and rocker arms 21 and 21', cam 17 opens and closes the aforesaid intake and exhaust valves 14*a* and 14*b* at a previously determined timing.

The aforesaid rocker arms 21 and 217 are supported by shafts 23. They swing back and forth in a see-saw motion, and the back-and-forth travel of the aforesaid push rods 15 is conveyed to intake and exhaust valves 14*a* and 14*b*. The aforesaid valve springs 18 accurately transmit the stroke of cam 17*a* to the intake and exhaust valves. This means that a powerful force (a fixed load) is exerted in the direction in which valves 14*a* and 14*b* close.

This is why the aforesaid rocker arms 21 and 21' have the aforesaid rocker arm shafts 23, which have a relatively large diameter in order to be sufficient to withstand the powerful force from the valve spring. When the OHV engine is working, cylinder 2 and cylinder head 8 undergo thermal expansion. To prevent the components of the aforesaid valve operating mechanism 74 which touch each other from experiencing excessive force, the specified clearance for the tappets must be set for the time when the engine is cool and it must be adjusted by turning the aforesaid screws 24 when the engine is assembled.

The detailed structure of the fourth preferred embodiment is shown in FIG. 13 through FIG. 17. 14*a* is the intake valve, 14*b* is the exhaust valve and 74 is the valve operating mechanism. The said operating mechanism 74 is enclosed in valve operating mechanism chamber 92, which is formed from the upper chamber of cylinder head 8 and head cover 9. It comprises the aforesaid rocker arm supporting base 22; rocker arm shafts 23; rocker arms 21 and 21'; adjustment screws 24; valve springs 18; push rods 15; tappets 16; and cam 17*a*.

8*c* is the peripheral wall of the aforesaid cylinder head 8. It also serves as the wall of the aforesaid valve operating mechanism chamber 92. On the top of the head is a top surface 101 (see FIG. 12), on which head cover 9 is fixed (see FIG. 10) sandwiching gasket 93 (shown by hatched lines in FIG. 13).

8*t* are female screws which are drilled in four places on the top surface of the aforesaid peripheral wall 8*c* to fix head cover 9 to the cylinder head. 8*n* are four female screws to fix the aforesaid rocker arm supporting base 22. 8*d* is a cylindrical mounting post for the said rocker arm supporting base 22. 8*e* is the female screw in which spark plug 51 (see FIG. 10) is mounted.

93*b* is a circular hole which is cut in the aforesaid gasket 93 for the aforesaid mounting post 8*m* to go through. 93*a* is the protruding segment of the said gasket 93. Breather passage 95, which will be discussed shortly, is cut in such a way that its top is covered by this segment. The said segment 93*a* is held in position when the aforesaid cylindrical mounting post 8*m* engages in the aforesaid circular hole 93*b*. When the aforesaid rocker arm supporting base 22 is fixed to cylindrical mounting post 8*m*, the segment is prevented from slipping off the bottom of that post.

Figure 14:
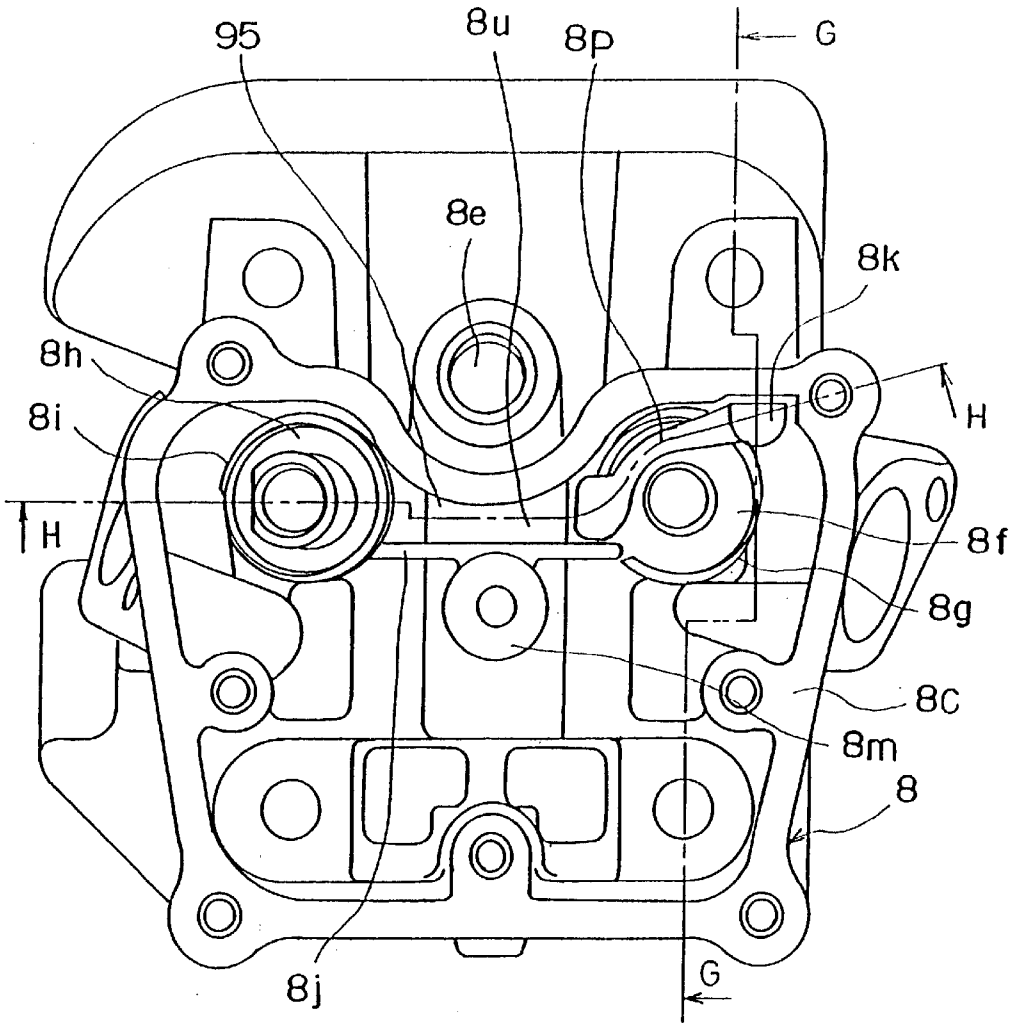
FIG. 14 is a plan view of the cylinder head in the aforesaid fourth preferred embodiment.

In FIG. 14, 8*f* is the spring retainer for one valve spring 18, the spring for the aforesaid intake valve 14*a*. 8*h* is the spring retainer for the other valve spring 18, the spring for the aforesaid exhaust valve 14*b*.

8*g* is a ring-shaped rib which is built up around the aforesaid spring retainer 8*f*. This rib keeps the valve spring 18 for the aforesaid intake valve 14*a* in the proper position. 8*i* is another ring-shaped rib which is built up around the aforesaid spring retainer 8*h*. This rib keeps the valve spring 18 for the aforesaid exhaust valve 14*b* in the proper position.

Square-sided groove 8*m*, which will be discussed shortly, and oil guide washer plate 76 for the spring retainers is provided in ring-shaped rib 8*g* for the aforesaid intake valve and ring-shaped rib 8*i* for the exhaust valve. The groove and washer plates constitute tubular passages 8*p* (as shown in FIG. 15).

8*j* is a straight guide wall which is connected to post 8*m*, the mounting post for the aforesaid rocker arm supporting base 22 for the rocker arm shaft bearings. This relatively thin wall stands in a straight line on the aforesaid mounting post 8*m* between intake valve 14 and exhaust valve 14*a* in the fashion that it approaches the aforesaid ring-shaped ribs 8*g* and 8*i*. As can be seen in FIG. 15, the height of this wall is slightly less than the top surface 101 of the aforesaid peripheral wall 8*c*.

94 is a breather passage. It goes vertically through cylinder head 8 and cylinder 2 and communicates with crankcase 112.

Figure 15:
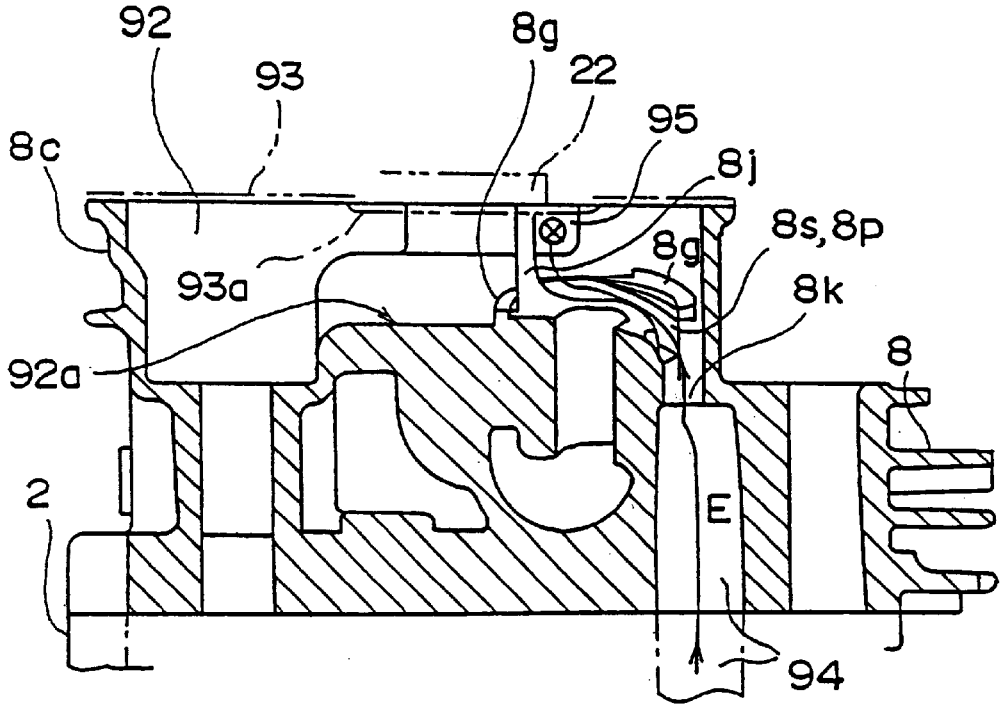
FIG. 15 is a cross section taken along line G—G in FIG. 14.

As is shown in FIGS. 14 and 15, the upper end of the said breather passage 94 is opened facing opening 8*k* on the outer side of rib 8*g*, the positioning rib for valve spring 18 of intake valve 14*a*. Through the said opening 8*k*, the breather passage is opened toward valve operating mechanism chamber 92 for the valve operating mechanism.

Figure 16:
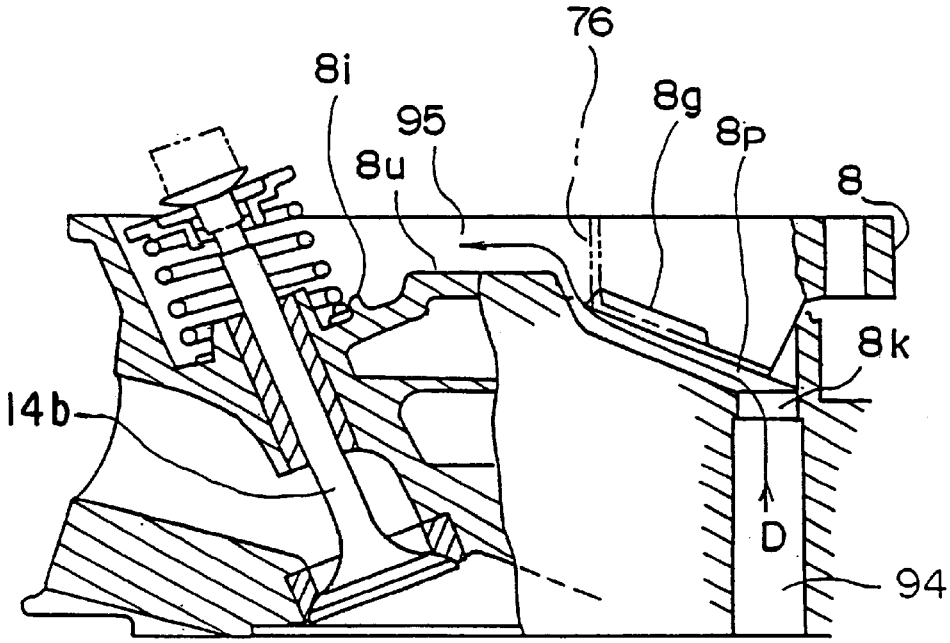
FIG. 16 is a cross section taken along line H—H in FIG. 14.

8*p* is a square-sided groove formed on the upper surface of the aforesaid cylinder head which faces valve operating mechanism chamber 92, or, the side of that valve operating mechanism chamber. A portion of rib 8*g*, the positioning rib for the aforesaid intake valve 14*a*, is cut away; 8*s* is the resulting opening. A plan view would show an S-shaped passage 8*p* going from spring retainer 8*f* for the intake valve toward spring retainer 8*h* for the exhaust valve. One end of the said square-sided groove 8*p* communicates with the aforesaid opening 8*k*; the other, as can be seen in FIG. 16, communicates with the space above center protrusion 8*u* in the center of the upper surface of cylinder head 8. The passage is configured with an angle sufficient to cause one end portion near the central protrusion to be higher than another end portion.

In the small multipurpose OHV engine of this fourth preferred embodiment, the aforesaid square-sided groove 8*p* should ideally be 3 to 5 mm deep.

Breather passage 95, then, goes from the aforesaid opening 8*k* through groove 8*p*, over center protrusion 8*u* in the center of the head which is the base of the aforesaid straight guide wall 8*j*. It makes use of the tunnel formed by the aforesaid straight guide wall 81 and the peripheral wall 8*a* of the cylinder head, which goes as far as spring retainer 8*h* of exhaust valve 14*a*.

In FIGS. 13 through 17, 76 is the oil guide washer plate for the spring retainer for intake valve 14*a*.

Figure 17:
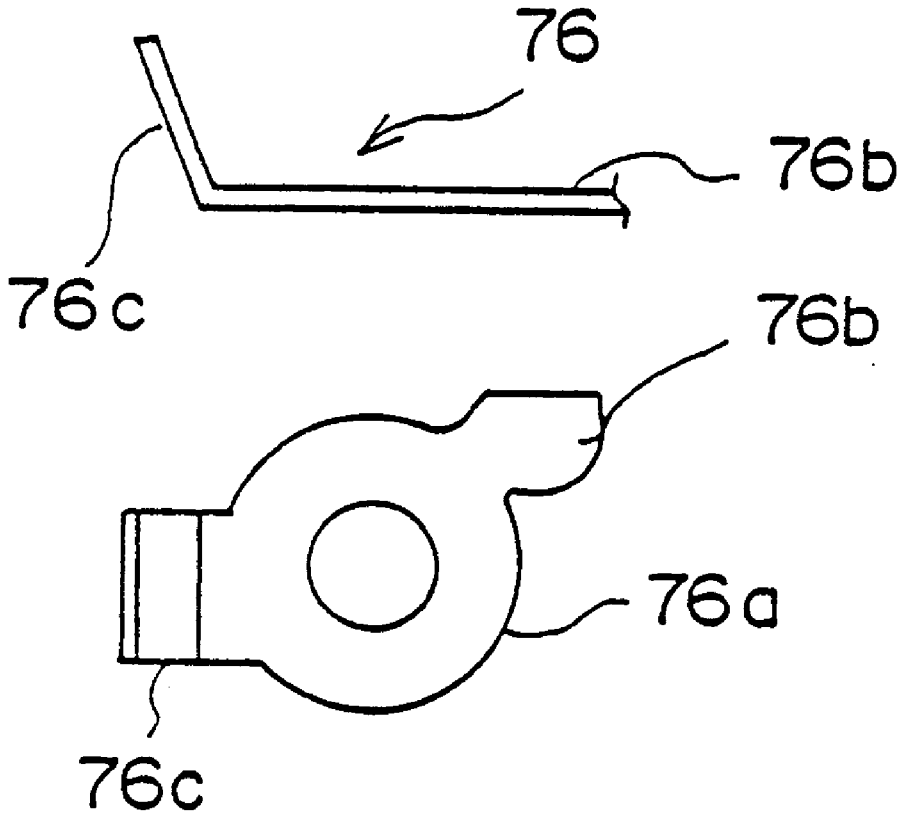
FIG. 17 shows the oil guide washer plate in the aforesaid fourth preferred embodiment. (a) is a frontal view and (b) is a plan view.
Figure 18:
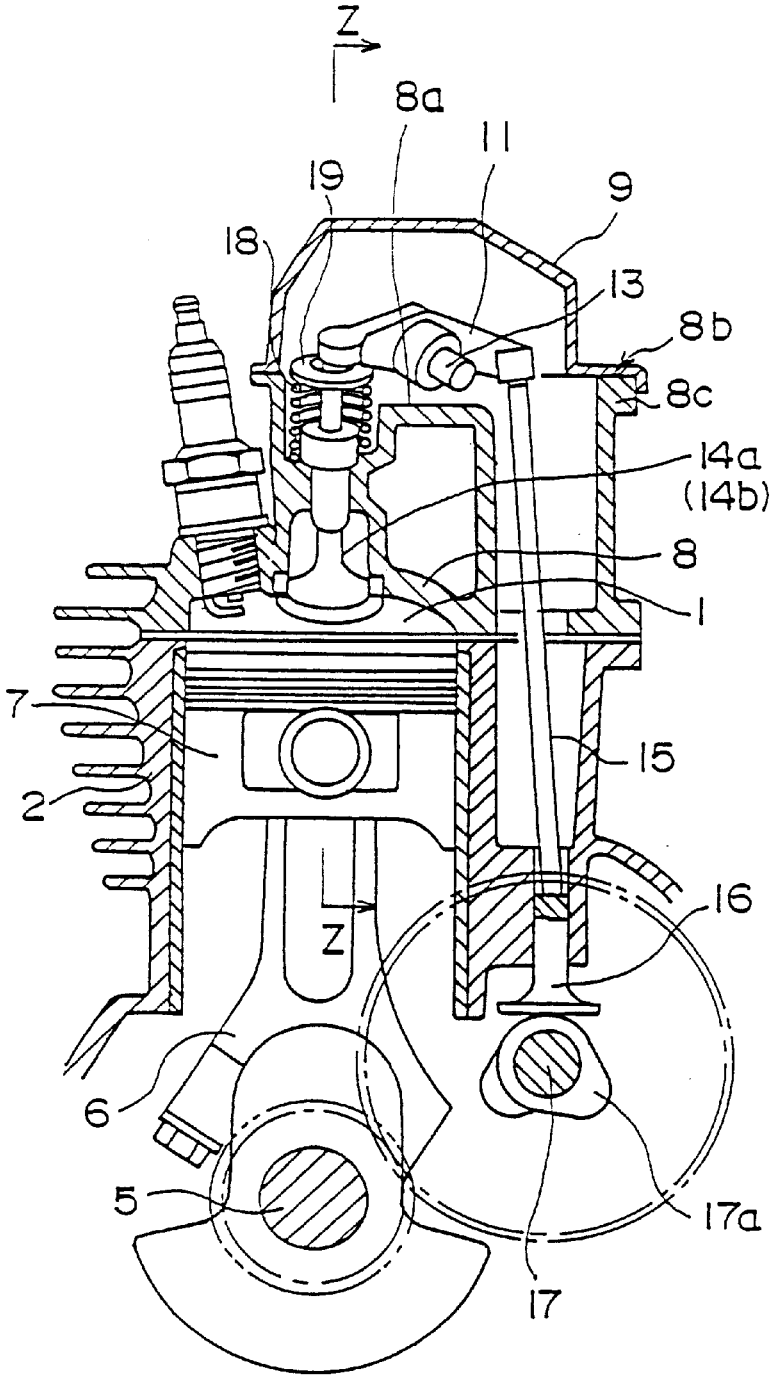
Figure 18 Prior Art
FIG. 18 is a lateral cross section, cut along the center line of the cylinder and push rod, of a multipurpose OHV engine which is an example of the prior art.
Figure 19:
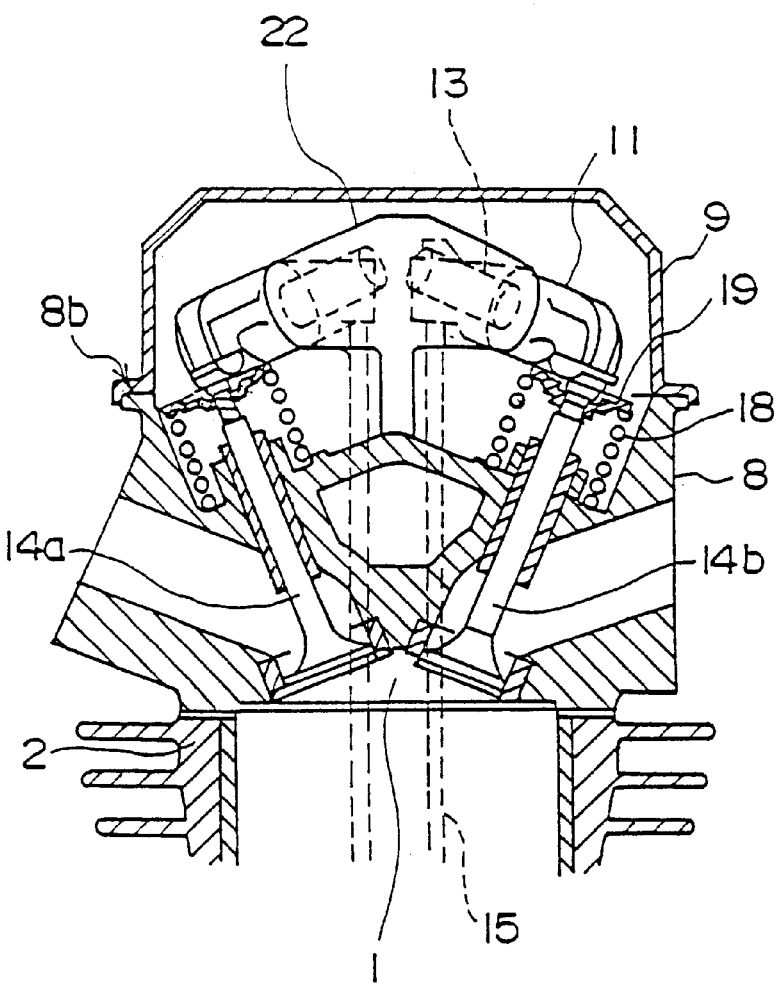
Figure 19 Prior Art
FIG. 19 is a cross section taken along line Z—Z in FIG. 18.

In FIGS. 17 (*a*) (a frontal view) and (*b*) (a plan view), the aforesaid oil guide washer plate 76 comprises washer portion 76*a*, entrance portion 76*b* and exit portion 76*c*. The said washer portion 76*a* engages within ring-shaped rib 8*g* near the aforesaid intake valve 14*a*. When intake valve 14*a* is installed, the elastic force of valve spring 18 exerts downward pressure to the foresaid oil guide washer plate on spring retainer 8*f*. The said entrance portion 76*b* and part of exit portion 76*c* jutting out through opening 8*s* of the foresaid 32, ring-shaped rib 8*g* cover the opening 8*k* in the aforesaid breather passage 94 and the top of S-shaped groove 8*p*. The gap between the end of the aforesaid straight guide wall 8*j* and peripheral wall 8*c* of cylinder head 8 is covered by the aforesaid exit portion 76*c*.

Figure 20:
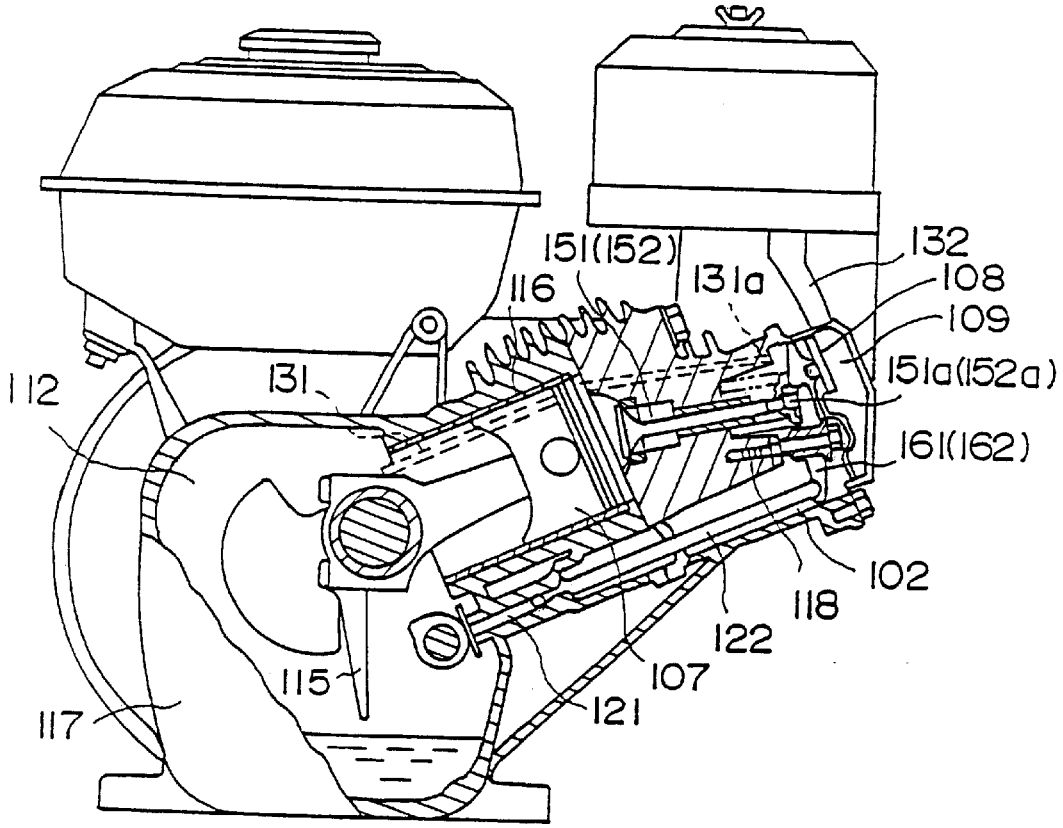
Figure 20 Prior Art
FIG. 20 is a vertical cross section of another example of the prior art.
Figure 21:
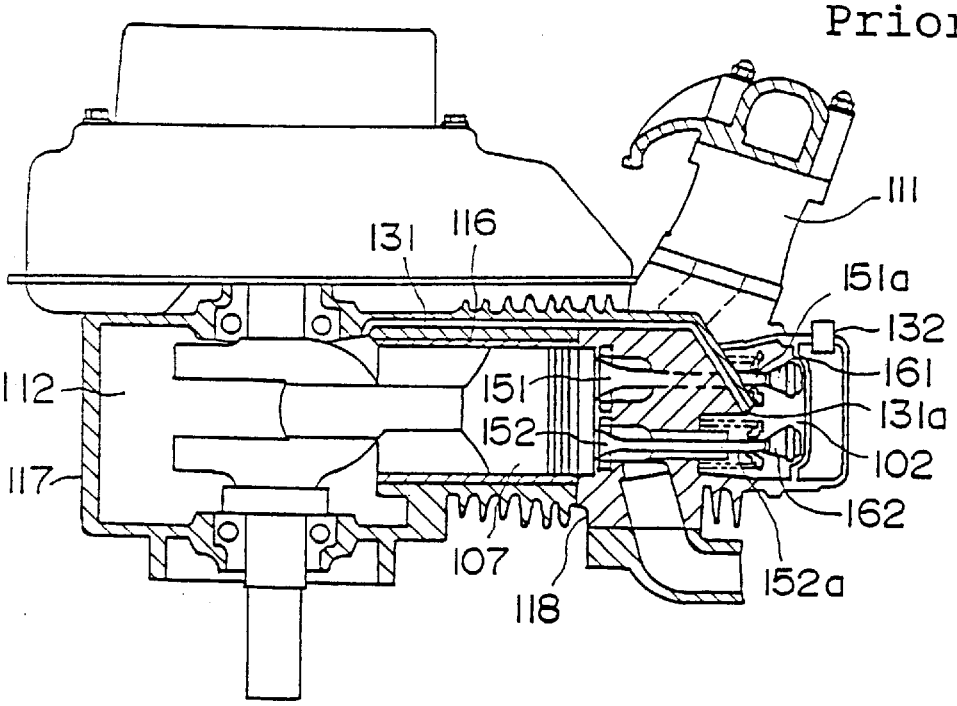
Figure 21 Prior Art
FIG. 21 is a vertical cross section of the prior art shown in FIG. 20.
Figure 22:
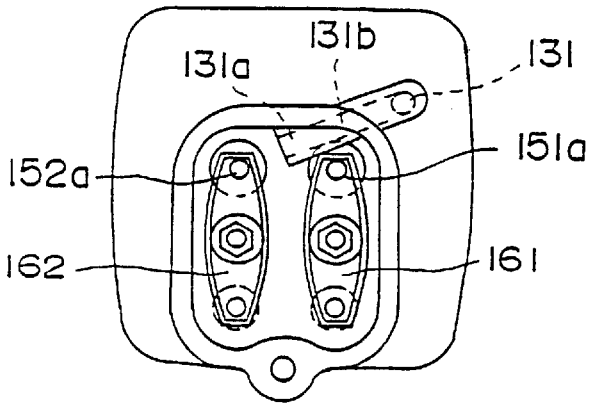
Figure 22 Prior Art
FIG. 22 is a plan view of the valve operating mechanism of the prior art shown in FIG. 20.

The OHV engine in FIG. 10 according to the fourth preferred embodiment has a lubrication device for its valve operating mechanism which is functioned in the following way. As shown in FIG. 10, when it operates and piston 7 moves downward, the volume of space in crankcase 112 is reduced. The oil picked up by oil dipper 115 (as shown in FIG. 20) and suspended in crankcase 112 is forced by the air moving through the crankcase to go up to the direction shown by arrow D in FIG. 16 and arrow E in FIG. 15. This suspended oil travels through breather passage 94 and goes as far as opening 8*k* in cylinder head 8.

At this point the said suspended oil takes a horizontal turn, passes through S-shaped groove 8*p* and exits from its front end. It then travels through the aforesaid breather passage 95, which is formed by straight guide wall 8*j* and peripheral wall 8*c* of cylinder head 8, toward exhaust valve 14*b*. A portion of the suspended oil which is moving forward is repulsed through the gap at the exit portion 76*c* of the aforesaid oil guide washer plate 76, and it is blown, in an appropriate quantity, to intake valve 14*a*. In this way the said valve 14 is lubricated.

As is stated above, in this fourth preferred embodiment, breather passage 95 comprises square-sided groove 8*m*, which runs between spring retainer 8*f* for supporting the valve spring 18 of intake valve 14*a* in cylinder head 8 and spring retainer 8*h* for supporting the valve spring 18 of exhaust valve 14*b*, and a tunnel-like passage. The said breather passage 95 communicates with breather passage 94, which connects with crankcase 112, via opening 8*k*. Thus the oil suspended in crankcase 112 is supplied in a reliable fashion from intake valve 14*a* to exhaust valve 14*b* in valve operating mechanism chamber 92. In this way a sufficient quantity of oil can be supplied not only to intake valve 14*a*, but also to exhaust valve 14*b*, which experiences conditions of intense heat.

Since this breather passage 95 can be formed by the design of the top surface of cylinder head 8 which faces valve operating mechanism chamber 92, and gasket 93, it does not require any specialized parts. This allows the parts count to be reduced.

What is claimed is:

1. A lubrication device for an overhead-valve engine having a first breather passage connecting a valve operation mechanism chamber over a cylinder head provided with an intake valve and an exhaust valve, and a crankcase, and passing through said cylinder head and a cylinder, comprising:

an opening of said first breather passage provided in a vicinity of a spring retainer for said intake valve, which faces said valve operating mechanism chamber;

a groove formed by cutting on said cylinder head facing said valve operating chamber and connecting an end of said groove to said opening, and a second breather passage formed by a tunnel-like passage provided by a guide wall standing in said valve operating mechanism chamber and a peripheral wall of said cylinder head and connecting another end of said groove to said exhaust valve.

2. A lubrication device for overhead-valve engine according to claim 1, wherein said second breather passage is further comprising a protruding portion of a gasket provided between a top surface of said cylinder head and a head cover, which covers said tunnel-like passage.

3. A lubrication device for overhead-valve engine according to claim 1, wherein said second breather passage connects spaces surrounded with ring-shaped ribs which protrude from spring retainers for an intake valve spring and an exhaust valve spring by said groove formed by cutting on a portion of said ring-shaped rib and said tunnel-like passage.

* * * * *